US010086527B2

(12) United States Patent
Teetzel et al.

(10) Patent No.: US 10,086,527 B2
(45) Date of Patent: Oct. 2, 2018

(54) COMBINED REFLEX AND LASER SIGHT WITH ELEVATION MACRO-ADJUSTMENT MECHANISM

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/666,037

(22) Filed: Aug. 1, 2017

(65) Prior Publication Data

US 2017/0341257 A1 Nov. 30, 2017

Related U.S. Application Data

(62) Division of application No. 14/881,779, filed on Oct. 13, 2015, now Pat. No. 9,752,853.

(Continued)

(51) Int. Cl.
*F41G 1/35* (2006.01)
*B27B 5/20* (2006.01)

(Continued)

(52) U.S. Cl.
CPC ..... *B27B 5/207* (2013.01); *B27B 5/36* (2013.01); *B27B 7/00* (2013.01); *F41G 1/30* (2013.01);

(Continued)

(58) Field of Classification Search
CPC ..... F41G 1/30; F41G 1/32; F41G 1/34; F41G 1/345; F41G 1/35; F41G 1/16; F41G 1/17; F41G 1/18; F41G 1/20
See application file for complete search history.

(56) References Cited

U.S. PATENT DOCUMENTS 843,183 A 2/1907 Smith
1,386,027 A 8/1921 Reynolds
(Continued)

OTHER PUBLICATIONS

PCT search report in PCT/US2015/055269 dated May 5, 2016.

*Primary Examiner* — Derrick R Morgan
(74) *Attorney, Agent, or Firm* — McLane Middleton, Professional Association

(57) ABSTRACT

A combined reflex and laser sighting device is provided. In one aspect, the reflex sight and one or more laser elements are coaligned, such that both the reflex sight and the laser sight can be sighted in or boresighted to a weapon together in a single operation. In another aspect, one or more laser elements are mounted within a laser bench and aligned with a reflex sight attached to the laser bench. In yet another aspect, a plurality of laser elements are provided within the laser bench and are coaligned with each other and the reflex sight. In another aspect, a mounting block with yielding vertical and horizontal webs is provided to allow windage and elevation adjustments to be made to the reflex sight and laser elements together. In still another aspect, an elevation macro-adjustment mechanism is provided to provide a simple adjustment that that realign the sight to a weapon to accommodate different shooting scenarios, such as different velocity rounds, different target distances, and elevational differences of the shooter's vantage point.

26 Claims, 23 Drawing Sheets

Related U.S. Application Data

(60) Provisional application No. 62/063,210, filed on Oct. 13, 2014.

(51) Int. Cl.

| | |
|---|---|
| ***F41G 11/00*** | (2006.01) |
| ***F41G 1/30*** | (2006.01) |
| ***F41G 1/36*** | (2006.01) |
| ***B27B 5/36*** | (2006.01) |
| ***B27B 7/00*** | (2006.01) |

(52) U.S. Cl.

CPC ..... *F41G 1/35* (2013.01); *F41G 1/36* (2013.01); *F41G 11/003* (2013.01)

(56) References Cited

U.S. PATENT DOCUMENTS 2,148,272 A 2/1939 Brudge
3,826,012 A 7/1974 Pachmayr
4,247,161 A 1/1981 Unertl, Jr.
5,388,335 A * 2/1995 Jung ..... F41G 1/26 42/115
5,724,181 A * 3/1998 Negishi ..... G02B 23/105 356/252
8,047,118 B1 * 11/2011 Teetzel ..... F41G 1/473 235/414
8,100,044 B1 * 1/2012 Teetzel ..... F41G 3/06 235/414
8,407,927 B2 4/2013 Huber
8,448,374 B2 5/2013 Samson et al.
8,919,026 B2 12/2014 Hamilton
9,069,172 B1 * 6/2015 Morley ..... G02B 23/12
9,752,853 B2 9/2017 Teetzel et al.
2003/0140545 A1 7/2003 Huber
2004/0144013 A1 7/2004 Leatherwood
2005/0254126 A1 11/2005 Lin et al.
2007/0137089 A1 6/2007 William, III et al.
2008/0236018 A1 10/2008 Halverson
2009/0038202 A1 2/2009 Nemec
2009/0199452 A1 8/2009 Huber
2009/0224154 A1 9/2009 Jancic et al.
2010/0175298 A1 7/2010 Thomas et al.
2012/0043381 A1 * 2/2012 Teetzel ..... F41G 1/473 235/404
2012/0154907 A1 6/2012 Schmitt et al.
2012/0240446 A1 9/2012 Lee et al.
2013/0152447 A1 * 6/2013 Ostergren ..... F41G 1/30 42/123
2013/0167425 A1 7/2013 Crispin
2013/0276345 A1 10/2013 Hamilton
2014/0002815 A1 1/2014 Jaeschke et al.
2014/0049643 A1 2/2014 Segerstrom et al.
2014/0092588 A1 4/2014 Toman et al.
2014/0096431 A1 4/2014 Tang
2014/0123536 A1 5/2014 Hamm et al.
2015/0198415 A1 7/2015 Campean
2015/0267997 A1 9/2015 Collin et al.
2015/0316350 A1 11/2015 Hamilton
2016/0010949 A1 * 1/2016 Teetzel ..... F41G 1/35 42/115
2016/0033232 A1 * 2/2016 Cheng ..... F41G 1/345 42/114
2016/0040959 A1 2/2016 Davidson et al.
2016/0313089 A1 * 10/2016 Collin ..... F41G 1/30
2016/0377378 A1 * 12/2016 Collin ..... F41G 1/30 42/113
2017/0059278 A1 * 3/2017 Hartman ..... F41G 1/30

* cited by examiner

COMBINED REFLEX AND LASER SIGHT WITH ELEVATION MACRO-ADJUSTMENT MECHANISM

CROSS REFERENCE TO RELATED APPLICATIONS

This application is a divisional of U.S. application Ser. No. 14/881,779 filed Oct. 13, 2015, which claims the priority benefit of U.S. provisional application No. 62/063,210 filed Oct. 13, 2014.

BACKGROUND

The present disclosure relates to the field weapon sights and, in particular, to a combined reflex and laser sight.

Reflex sights are generally known in the art and typically include a battery-powered light source such as an LED or laser for projecting an illuminated reticle image, such as a red dot. Such reflex sights include a lens assembly (typically non-magnifying), e.g., employing a beam splitter or dichroic mirror allowing the user to view a target field of view. The lens assembly contains a reflective coating or film that reflects light from the light source along the viewing axis of the lens so that the viewer sees both the target field of view and projected reticle image superimposed thereon to aid the user in aiming the barrel of a firearm or other weapon. Laser sights are also known and comprise one or more laser devices configured to emit a laser beam onto a target for the purpose of aiding the user in aiming the barrel of a firearm or other weapon.

In each case, the alignment of the sight must be adjusted with respect to the barrel of the weapon (bore sighted) so that the position of the emitted light (i.e., the reticle image on the lens in the case of a reflex sight or the position of the laser beam on the target in the case of a laser sight) corresponds with or intersects the trajectory path of the fired projectile at the target. Adjusting the alignment of the sight typically involves adjusting the horizontal alignment (windage) and vertical alignment (elevation) using threaded adjustment screws, and can be a time consuming process. In the case of multiple sights, the horizontal and vertical alignment must be performed for each sight. In addition, even when a sight has been bore sighted for a particular weapon is may be necessary to re-bore sight for different conditions, including changes I distance to target (for example, long range vs short range or close combat conditions), differences in muzzle velocity or projectile speed for different types of ammunition rounds), and changes in incline (e.g., level shooting vs. elevated or depressed firing position relative to target), and so forth.

In one aspect, the present disclosure contemplates a new and improved sight apparatus including a combined reflex and laser sight that are coaligned and can be bore-sighted together. In another aspect, the sight apparatus herein includes an elevation macro-adjustment mechanism that can be used to adjust the bore sight to accommodate an anticipated change in shooting conditions.

SUMMARY

An integrated sight for a weapon is provided, the weapon being of a type having a barrel for firing projectiles, the barrel defining a longitudinal bore axis. The integrated sight comprises a housing having a front end configured to be positioned toward a front end of the weapon and a rear end configured to be positioned toward the rear end of the weapon. A fastener removably attaches the housing to the weapon. A laser sight is disposed within the housing. The laser sight comprises an optical bench comprising at least one aperture positioned toward the front end of the housing; at least one laser tube disposed within the optical bench to emit a laser beam through the at least one aperture; and a mounting block attaching the optical bench to an internal surface of the housing. A reflex sight is attached to the housing and includes a base securely attached to the optical bench; a light source securely attached to the base; and a lens assembly positioned frontward of the light source and configured to reflect a collimated light beam from the light source toward the rear end of the housing. The collimated light beam from the light source and the laser beam from the at least one laser tube are coaligned and the optical bench is rotationally adjustable within the housing about a first pivot axis and about a second pivot axis, wherein the longitudinal bore axis, the first pivot axis, and the second pivot axis are mutually orthogonal.

An integrated weapon sight comprises a housing and a fastener for providing a rigid connection of the housing to a weapon. A visual sight is disposed within the housing, the visual sight having a movable portion that is vertically adjustable in relation to the housing. An elevation adjustment mechanism is provided for selectively moving the movable portion up and down, the elevation adjustment mechanism contacting the housing and a first surface of the movable portion of the visual sight. The elevation adjustment mechanism comprises an elevation macro-adjustment mechanism comprising at least one pair of rings, each pair comprising a first ring fixed to a portion of the housing; and a second ring having an external lever, the second ring coaxially coupled to the first ring about an adjustment axis and capable of rotating relative to the first ring by moving the lever in an arc. The elevation adjustment mechanism also comprises an elevation micro-adjustment assembly coupled to the elevation macro-adjustment mechanism and configured to selectively alter its position along the adjustment axis, wherein the elevation micro-adjustment assembly is adjustably disposed within the first and second rings of the elevation macro-adjustment mechanism such that rotation of the second ring relative to the first ring results in displacement of the elevation micro-adjustment assembly along the adjustment axis of the first and second rings, thereby causing a vertical adjustment of the movable portion of the visual sight within the housing. A spring is disposed between an internal surface of the housing and a second surface of the movable portion of the visual sight, the first surface and second surface being on opposite sides of the movable portion of the visual sight.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
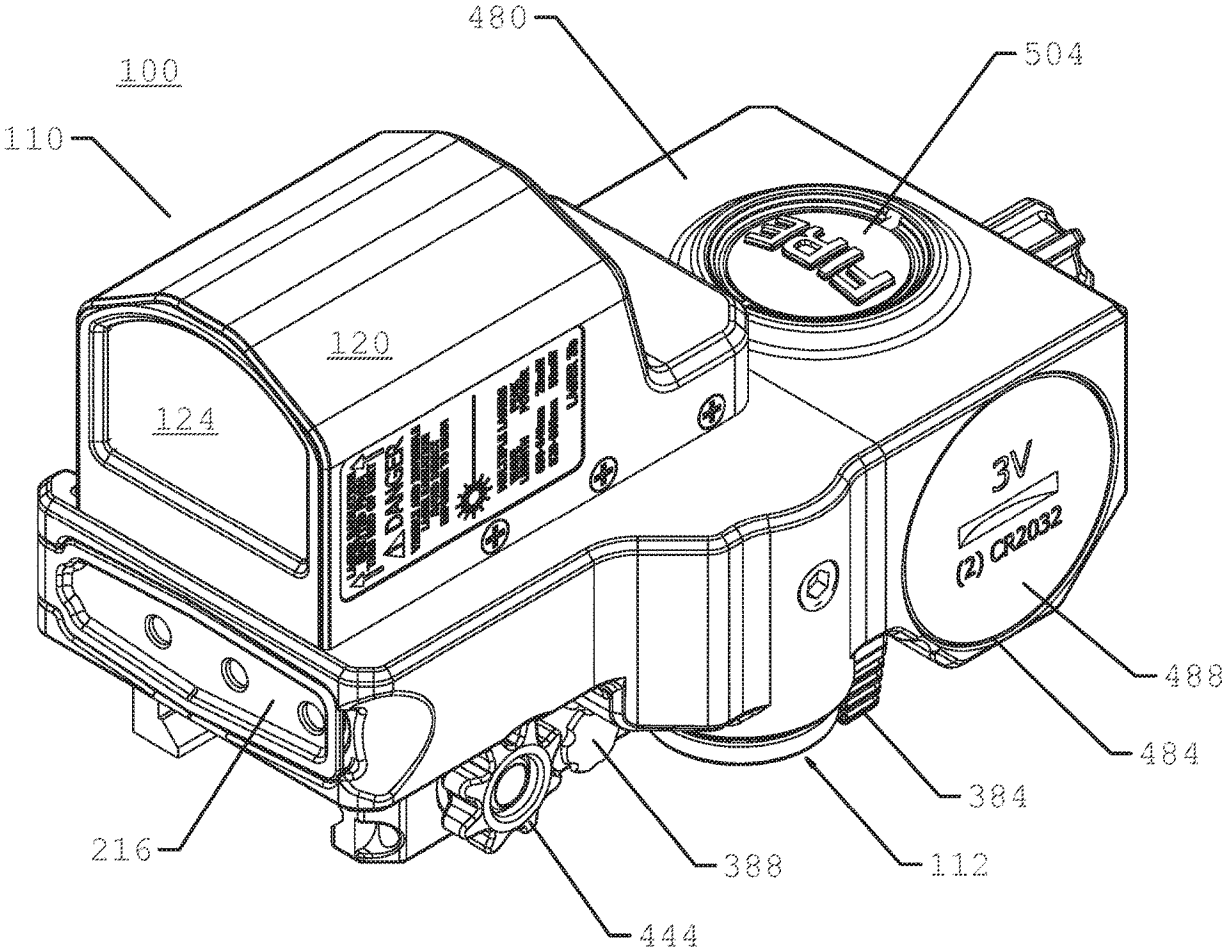
FIG. 1 is an isometric view of a combined reflex and aiming sight in accordance with an exemplary embodiment of the invention, taken generally from above, the front, and the right side.

Referring now to the drawings, wherein like reference numerals refer to like components throughout the several views, FIGS. 1-15 illustrate a combined aiming and reflex sight 100, which includes a reflex sight assembly 110 and a laser sight assembly 112. For purposes of this disclosure, the relative terms left, right, up, and down are based on the orientation of the unit 100 shown in FIG. 7 and from the perspective of a person facing the front of the unit.

The reflex sight assembly includes a base 116 and a cover 120. A light source 122 such as an LED or laser, e.g., an eye-safe laser, is received within the base 116 and is enclosed by a housing cover 118. The light source 122 emits light that impinges on a lens assembly 124. The lens assembly 124 functions as a partially reflective mirror (e.g., beam splitter or dichroic mirror), for example, which may include a reflective coating or film 128 therein to reflect light from the light source 122 back toward the user. The light from the light source is preferably collimated, e.g., using a collimating lens. The lens assembly 124 also allows light reflected from the target field of view to pass through, wherein the collimated light from the light source 122 appears as a superimposed reticle on the target field of view. The superimposed reticle may appear as a dot 113, e.g., a red or green dot, although other reticle shapes, such as rings and cross hairs are also contemplated.

A lens retainer 132 secures the lens assembly 124 to the base 116. The vertical position of the collimated light from the light source 122 on the lens assembly 124 is adjusted using a threaded adjustment screw 136. The horizontal position of the collimated light from the light source 122 on the lens assembly 124 is adjusted using a threaded adjustment screw 140. The adjustment screws 136 and 140 therefore provide elevation and windage adjustments, respectively, for the reflex sight. Once the light source 122 and the lasers elements of the laser sight, as described in detail below, have been coaligned, a potting compound may be used to maintain the light source 122 in its aligned position.

The lens retainer 132 is secured to the base 116 via threaded fasteners 144. The base 116, in turn is secured to an optical bench 148 via threaded fasteners 152. Oval pads 150 are disposed between the lower surface of the base 116 and the upper surface of the optical bench 148. The cover 120 is secured over the reflex sight assembly 110 and is secured to upstanding rails 168 on a front laser module housing 160 via threaded fasteners 156.

The optical bench 148 includes a front section 172 having three generally cylindrical openings each receiving a laser tube 176*a*, 176*b*, and 176*c*. In the illustrated preferred embodiment, the lasers 176*a*, 176*b*, 176*c* include two pointing lasers of different wavelengths and an illuminator or flood laser. Preferably, the flood laser has a fixed flood width although focusing optics for selectively narrowing or broadening the flood beam are also contemplated.

In preferred embodiments, the laser tube 176*a* may be an infrared aiming or pointing laser for emitting an infrared laser beam onto a target, e.g., for viewing using a night vision device; the laser tube 176*b* may be an infrared flood to flood the target area with infrared light to improve viewability using infrared viewing equipment; and the laser tube 176*c* may be a visible pointing laser, e.g., for emitting a visible laser beam onto a target. In preferred embodiments, the IR flood and the IR pointing laser are operable individually, as well as together wherein a dot of higher intensity is visible within the flooded area with night vision equipment.

Three apertures 180*a*, 180*b*, and 180*c* are formed in the laser bench 148 and are aligned with the beams emitted by the respective laser tubes 176*a*, 176*b*, and 176*c*. The laser bench 148 further includes a rear cover 184, which retains the laser tubes within the bench 148 and is secured to the front portion 172 with threaded fasteners 188. Each of the three laser tubes are coaligned with each other and the reflex sight 110 using setscrews 192. Each laser 176*a*, 176*b*, and 176*c* has four setscrews 192 spaced at 90-degree intervals about its optical axis and are selectively advanced or retracted to move the lasers 176*a*, 176*b*, and 176*c* until all of the laser tubes within the bench are coaligned with each other and the reflex sight. Once the laser tubes 176*a*, 176*b*, and 176*c* are all aligned, a potting compound may be used to maintain the positions of the lasers 176*a*, 176*b*, and 176*c* in their co-aligned state.

The laser bench 148 is received within the main front housing section 160. The laser bench 148 has a mounting block 204 on the forward facing surface. The block 204 is secured to the main front housing section 160 via fasteners 208. The main housing 160 has apertures 212*a*, 212*b*, 212*c* aligned with the apertures 180*a*-180*c*, respectively. A hinged lens cover 216 is hingedly attached to the main front housing section 160 via a hinge pin 220.

Figure 5:
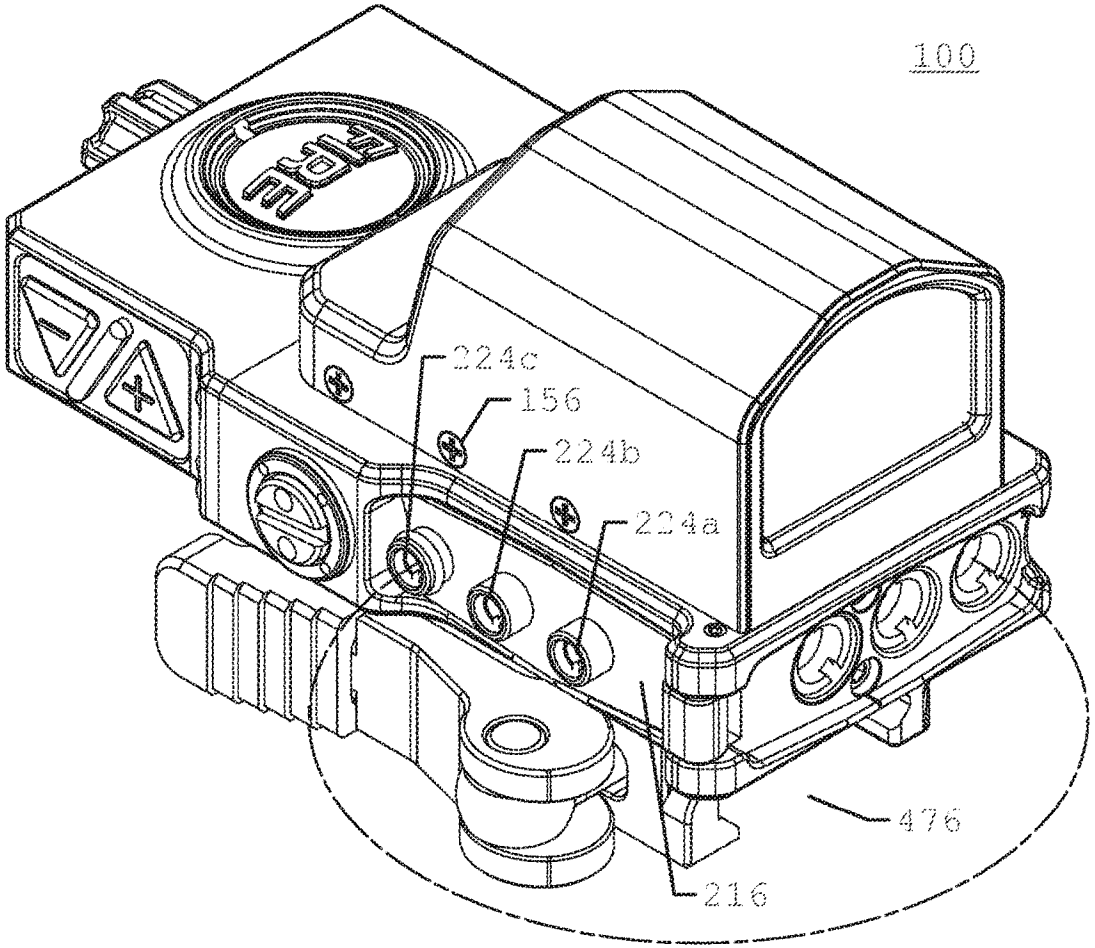
FIG. 5 is an isometric view of the sight appearing in FIG. 1, taken generally from above, the front, and the left side, illustrating pivoting movement of the eye safe filter.

The cover 216 carries three attenuators 224*a*, 224*b*, 224*c*, which are aligned with the apertures 212*a*-212*c* and the optical path of the lasers 176*a*, 176*b*, 176*c*, respectively, when pivoted to the operative position (see e.g., FIG. 1). FIG. 5 illustrates the manner of pivoting the lens cover 216 to the non-used position. The attenuators 224*a*, 224*b*, 224*c* may be optical filters that reduce the intensity of the laser beam to a level that is considered eye-safe. For example, it may be desirable to reduce the output intensity of the lasers 176*a*, 176*b*, 176*c* to an eye safe level when the unit 100 is used during training exercises. The main housing 160 and the hinged cover 216 may have complementary features, such as snap fit features, to provide positive retention of the cover in both the open and closed positions.

Figure 12:
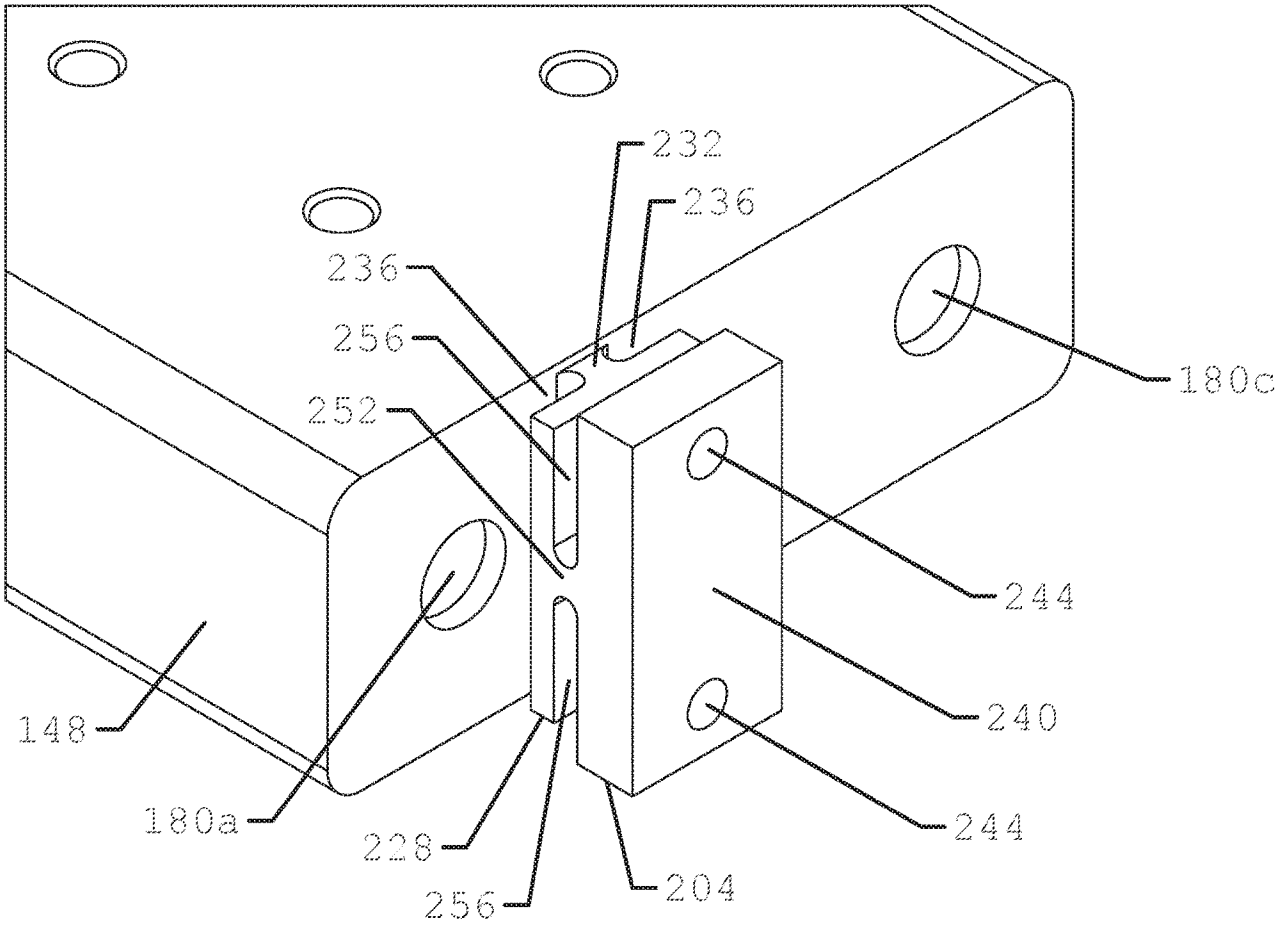
FIG. 12 is an enlarged fragmentary view of the laser bench showing the mounting block securing the laser bench to the main housing compartment.

The mounting block 204 may be an integrally formed part of the laser bench 148 and may be formed, for example, via a molding or machining process. Alternatively, the block 204 may be separately formed and attached to the front surface of the laser bench 148. As best seen in FIG. 12, the block 204 includes a flange 228 spaced apart from the front surface of the bench 148 and connected thereto by a vertical web 232 extending between the bench 148 and a rearward facing surface of the flange 228. The vertical web 232 is generally aligned with a vertical centerline of the flange 228 and two vertically extending channels 236 are defined on opposite sides of the vertical web 232. The vertical web 232 is resilient, allowing the bench 148 to pivot about the long axis of the vertical web 232.

The block 204 further includes a mounting foot portion 240 having openings 244 for receiving the threaded fasteners 208 to affix the mounting block to the front main housing section 160. The mounting foot portion 240 is spaced apart from the flange 228 and is connected by a horizontal web 252. A pair of horizontally extending channels 256 on opposite sides of the horizontal web 256 defines the forward facing surface of the flange 228 and the rearward facing surface of the foot portion 240. The horizontal web 252 is generally aligned with a horizontal centerline of the flange 228. The horizontal web 252 is resilient, allowing the bench 148 to pivot about the long axis of the horizontal web 252.

The resiliency of the horizontal web 252 allows the laser bench 148 to yield in response to a vertical force exerted on the laser bench 148, thereby allowing the alignment of the laser bench 148 to be adjusted relative to the front main housing 160, thus providing a vertical adjustment of the laser beams emitted by the lasers 176*a*, 176*b*, 176*c*. Likewise, the resiliency of the vertical web 232 allows the laser bench 148 to yield in response to a horizontal force exerted on the laser bench 148, thereby allowing the alignment of the laser bench 148 to be adjusted relative to the main housing 160, thus providing a side-to-side adjustment of the laser beams emitted by the lasers 176*a*, 176*b*, 176*c*.

Figure 8:
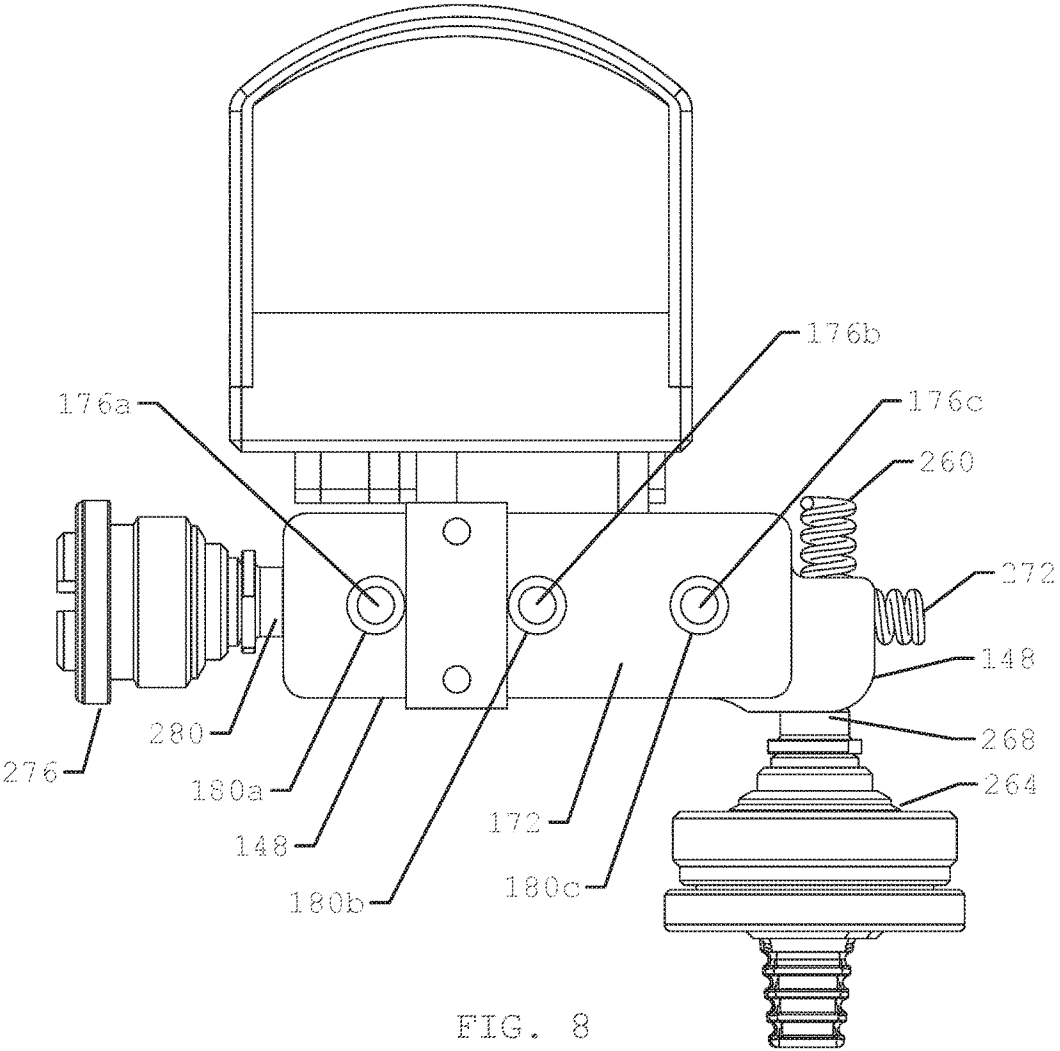
FIG. 8 is a front elevational view of the sight appearing in FIG. 1 with the housing removed.
Figure 9:
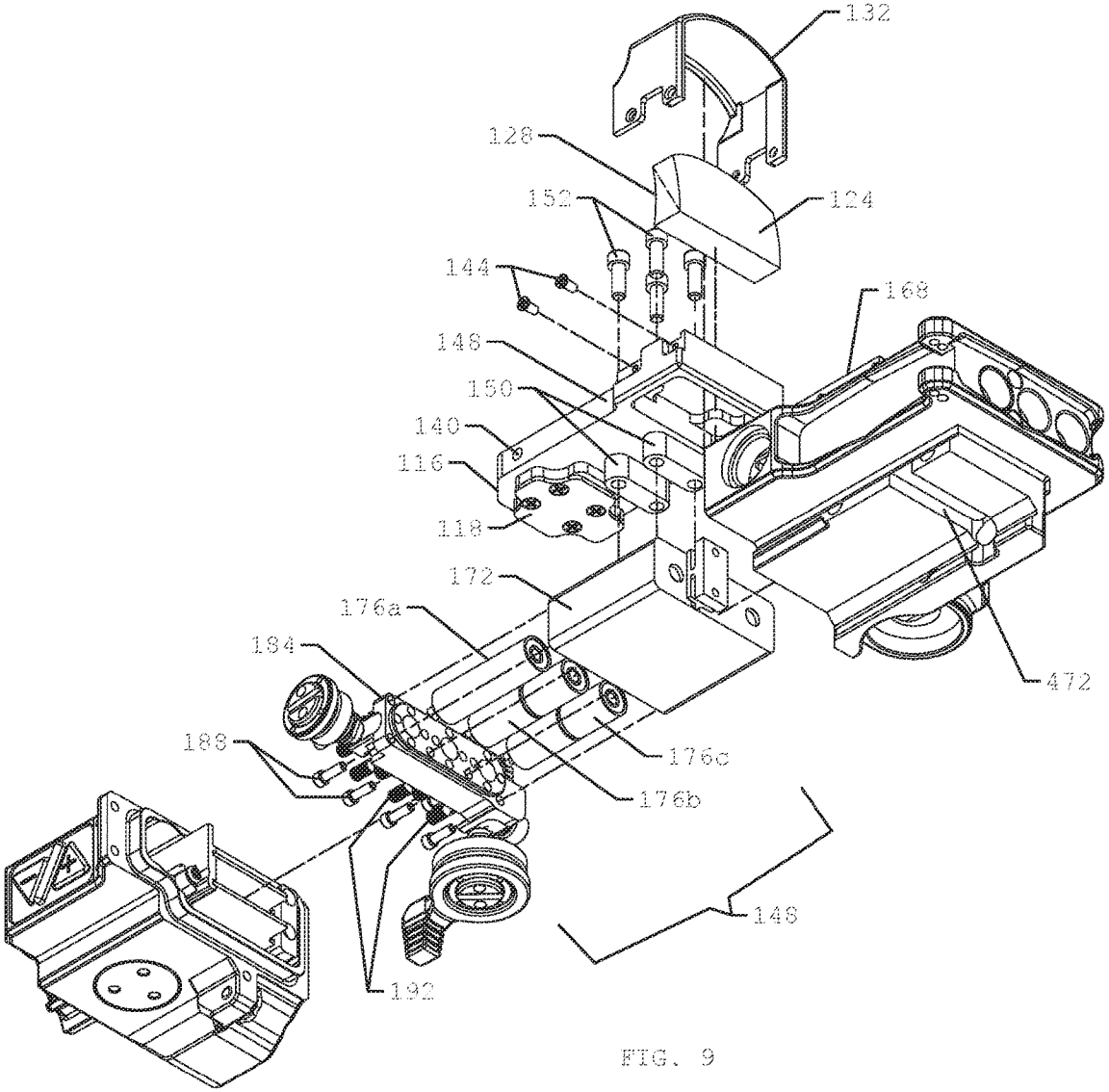
FIG. 9 is an exploded isometric view of the sight appearing in FIG. 1, taken generally from below, the front, and the left side.
Figure 10:
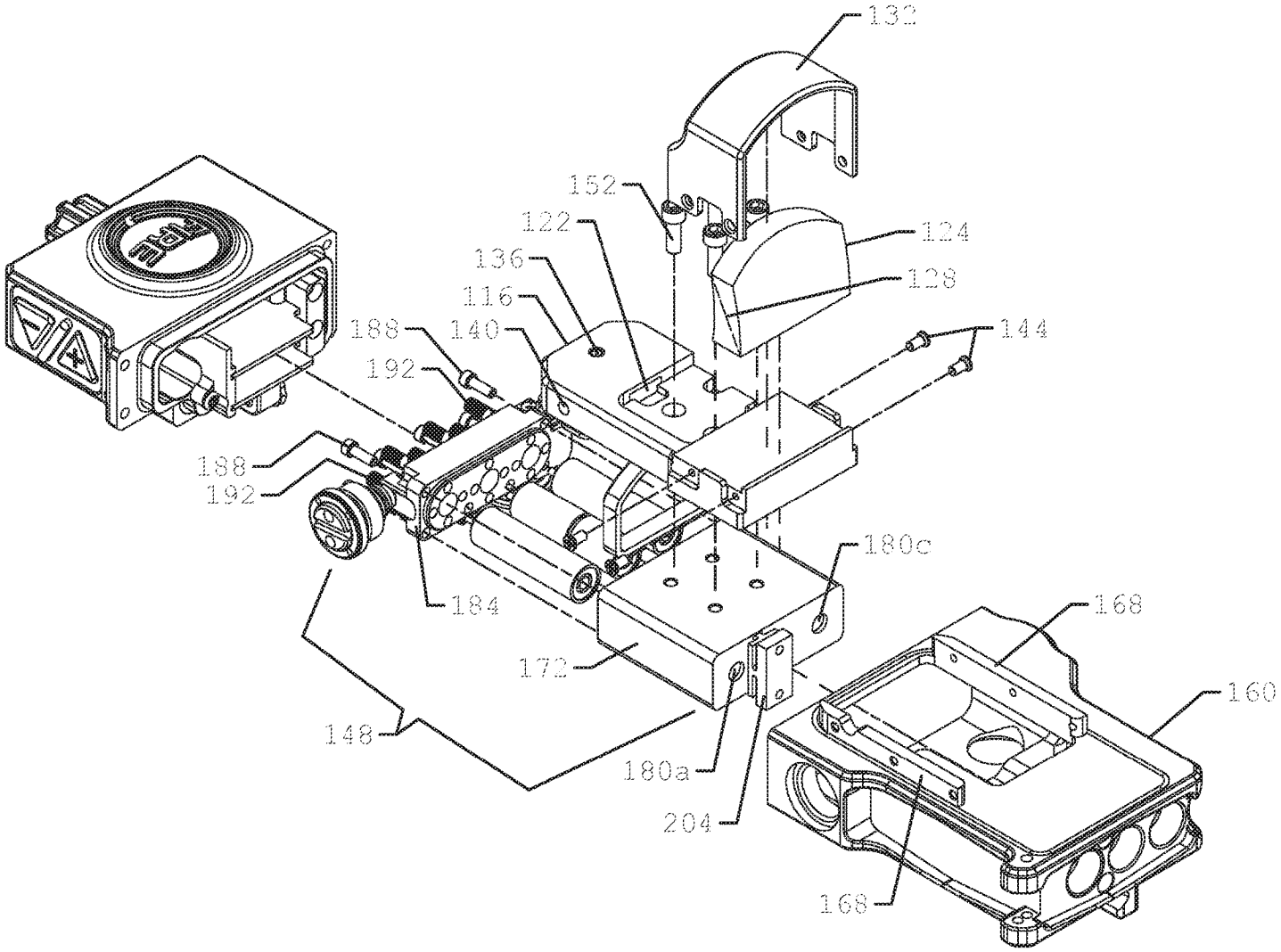
FIG. 10 is an exploded isometric view of the sight appearing in FIG. 1, taken generally from above, the front, and the left side.

As best seen in FIG. 8, a downward vertical force is exerted on the laser bench by a first spring 260 bearing against an upper surface of the bench 148, thereby tending to urge the rearward end of the laser bench 148 downward. An elevation micro-adjustment assembly 264 includes a bearing member 268, which bears against a lower surface of the laser bench 148, opposing the urging of the first spring 260.

A leftward vertical force is exerted on the laser bench by a second spring 272 bearing against a right side surface of the bench 148, thereby tending to urge the rearward end of the laser bench 148 to the right. A windage adjustment assembly 276 includes a bearing member 280 which bears against a right side surface of the laser bench 148, opposing the urging of the second spring 272.

Figure 6:
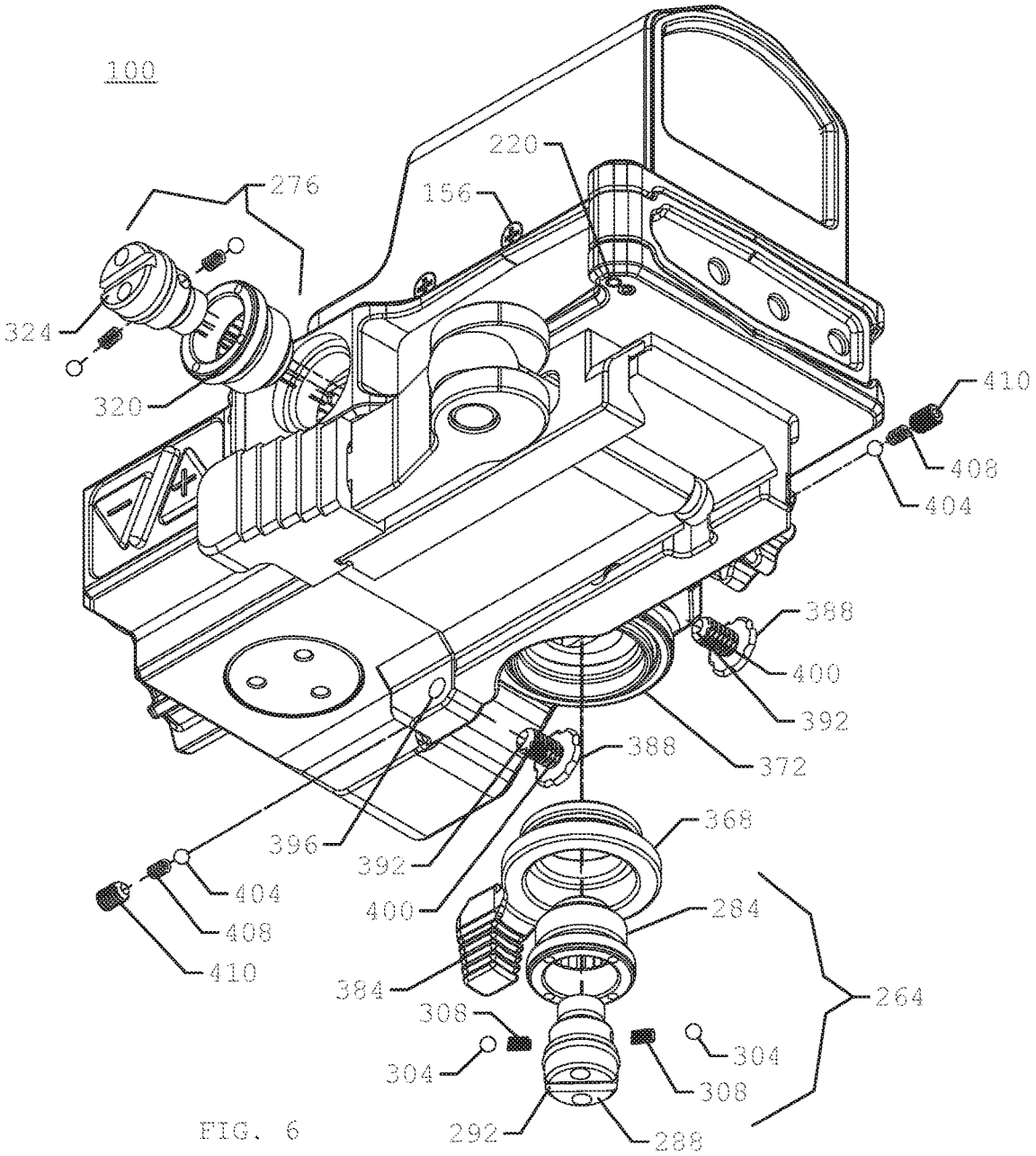
FIG. 6 is a partially exploded isometric view of the sight appearing in FIG. 1, taken generally from below, the front, and the left side.
Figure 7:
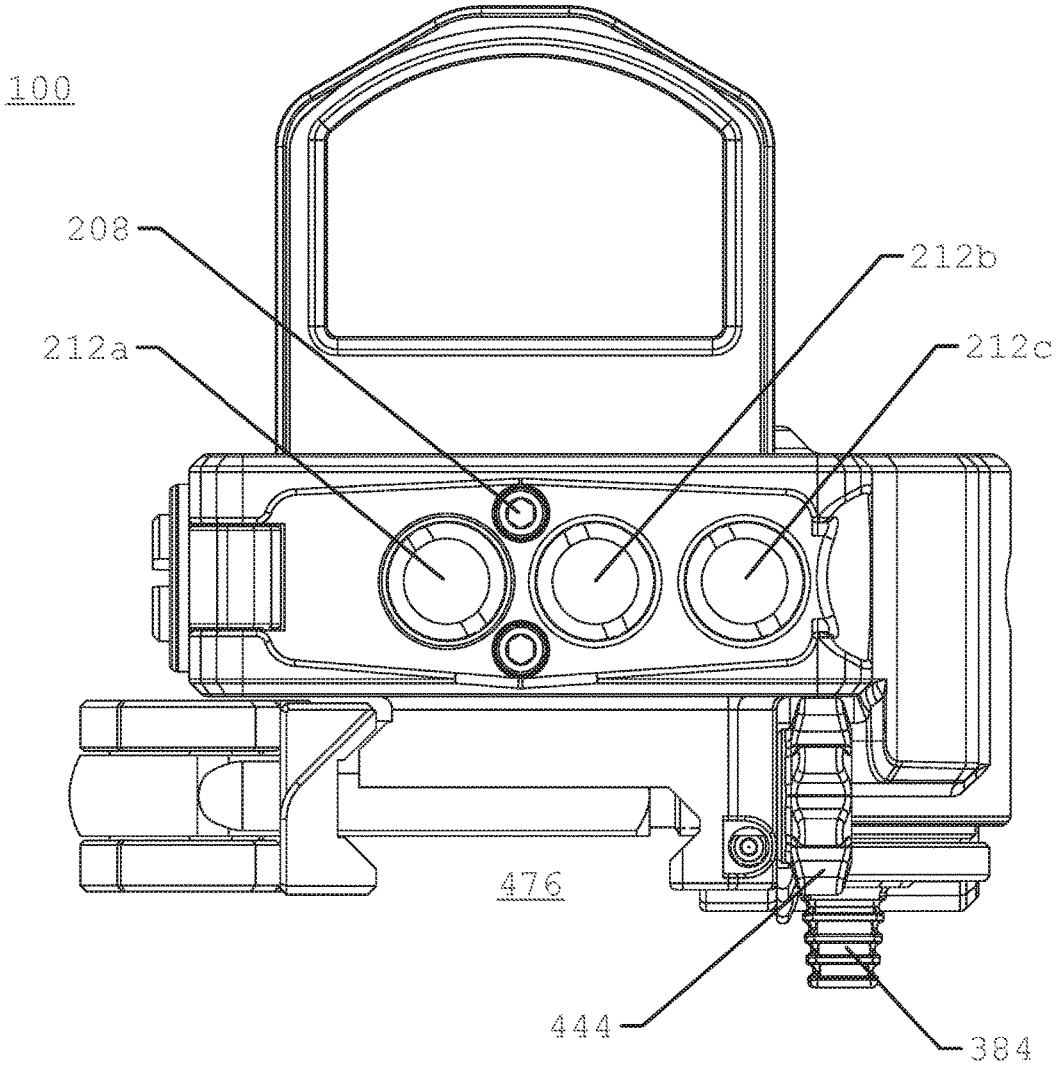
FIG. 7 is a front elevational view of the sight appearing in FIG. 1.
Figure 13:
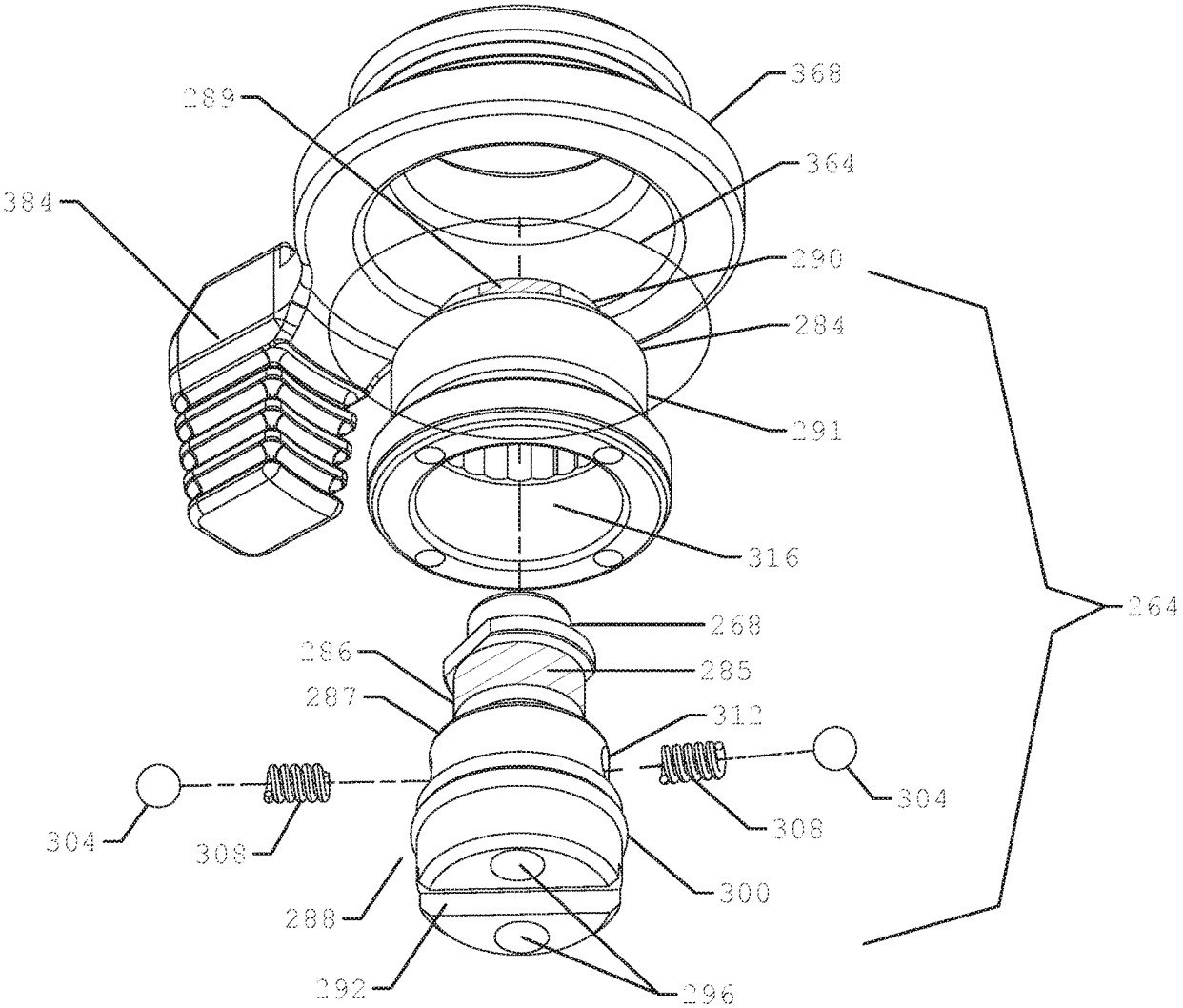
FIG. 13 is an enlarged exploded view of the elevation micro-adjustment assembly.

As best seen in FIGS. 6 and 13, the elevation micro-adjustment assembly 264 includes a sleeve 284 which rotatably receives a rotatable barrel 288. The rotatable barrel includes the bearing member 268 which protrudes from the open end of the sleeve and engages the surface of the bench 148 as described above. An exterior helical thread 285 on the threaded section 286 of the barrel 288 engages a complementary interior thread 289 (shown in broken lines) on the interior of the threaded section 290 of the sleeve 284 such that rotation of the barrel 288 in one direction causes the bearing member to advance toward the laser bench 148 against the urging of the spring 260. The resilient or yielding nature of the horizontal web 252 allows the bench 148 to pivot about the axis of the horizontal web, compressing the spring 260, thereby adjusting the direction of the lasers downward relative to the main housing section 160, and, in turn, relative to the barrel of the weapon to which the unit is attached.

Rotation of the barrel 288 in the other direction causes the bearing member to move away the laser bench 148. The resilient or yielding nature of the horizontal web 252 allows the bench 148 to pivot about the axis of the horizontal web toward the bearing member due to the spring force of the spring 260, thereby adjusting the direction of the lasers upward relative to the main housing section 160, and, in turn, relative to the barrel of the weapon to which the unit is attached.

The end of the barrel 288 further includes a slot 292 or other features 296 for engaging a tool for effecting rotation of the barrel 288 relative to the sleeve 284. An O-ring or gasket 300 provides a sealing engagement between the barrel 288 and an inner wall of the sleeve 284 for preventing the ingress of water or other contamination into the interior of the housing.

A detent mechanism includes balls 304 and springs 308 received within openings 312 in the side of the detent section 287 of the barrel 288. The balls are aligned with a scalloped interior surface 316 defining a plurality of axially extending grooves on the inner surface of the scalloped section 291 of the sleeve 284. The grooves may be placed at periodic angular intervals about the inner surface of the sleeve to provide to provide an audible and/or tactile click and positive retention at each angular position. In a preferred embodiment, the scalloped surface may comprise 24 grooves to provide a click and positive retention at every 15 degrees of rotation of the barrel 288.

Figure 14:
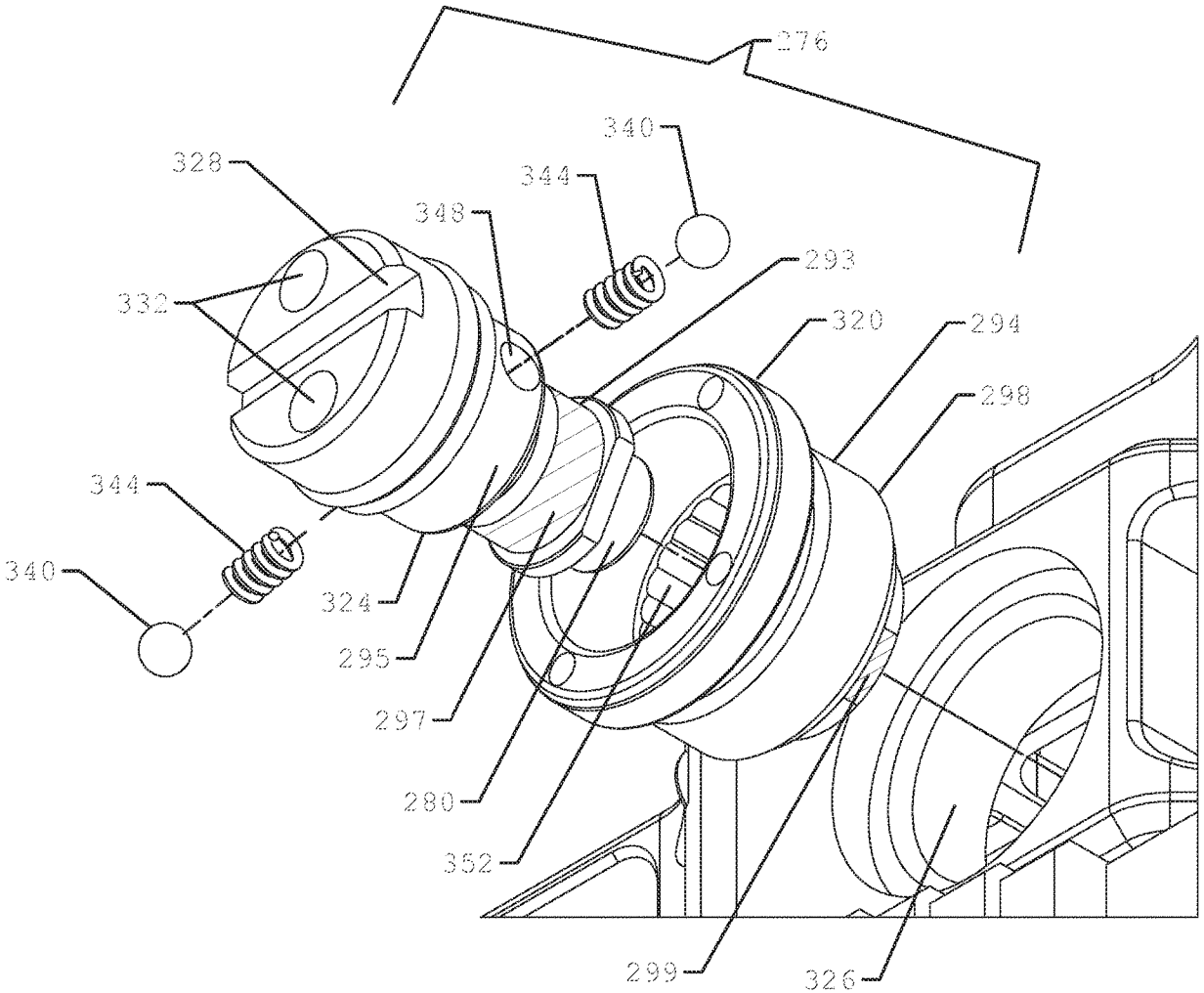
FIG. 14 is an enlarged exploded view of the windage adjustment assembly.
Figure 15:
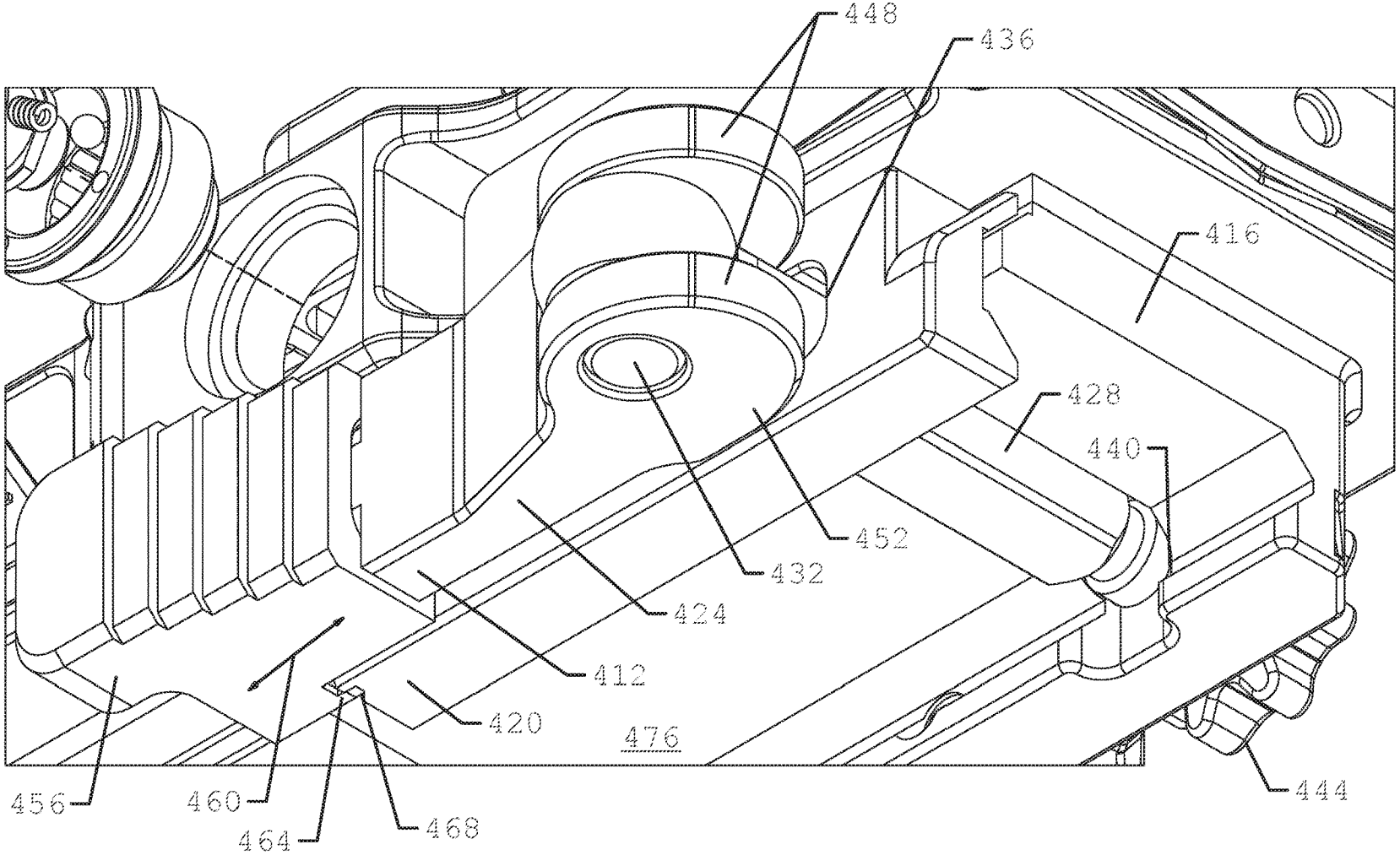
FIG. 15 is an enlarged fragmentary view of the sight herein illustrating the rail grabber assembly.
Figure 16:
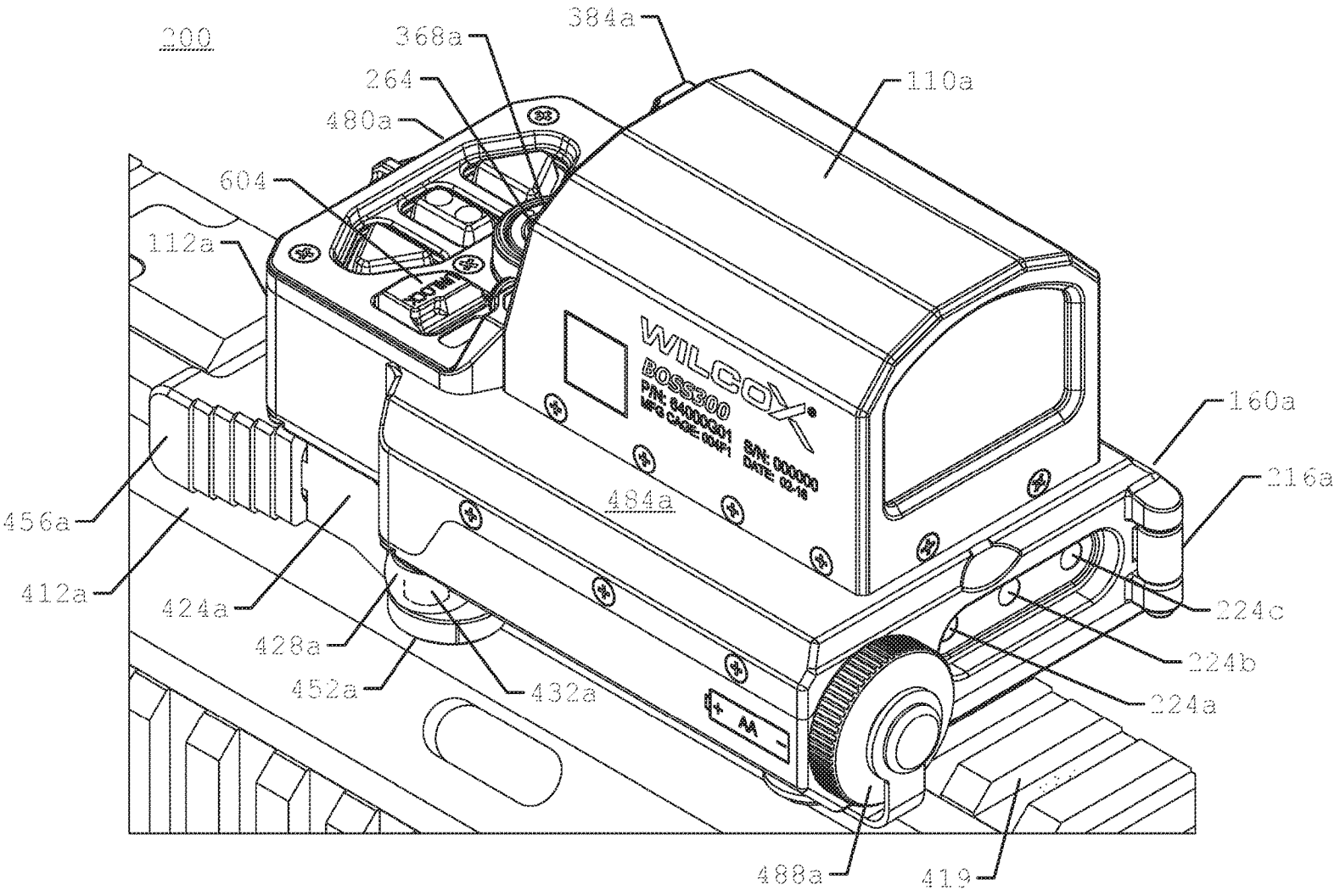
FIG. 16 is an isometric view of a combined reflex and aiming sight in accordance with a second exemplary embodiment of the invention, taken generally from the front and the left side.

As best seen in FIGS. 6 and 14, the windage adjustment assembly 276 includes a sleeve 320, which rotatably receives a rotatable barrel 324. The sleeve 320, in turn, is received within an opening 326 in the main front housing 160. The rotatable barrel includes the bearing member 280, which protrudes from the open end of the sleeve and engages the right side surface of the bench 148 as described above. An exterior helical thread 293 on the threaded section 297 of the barrel 324 engages a complementary interior thread 299 (shown in broken lines) on the interior of the threaded section 298 of the sleeve 320 such that rotation of the barrel 324 in one direction causes the bearing member to advance toward the laser bench 148 against the urging of the spring 272. The resilient or yielding nature of the vertical web 232 allows the bench 148 to pivot leftward about the axis of the vertical web, compressing the spring 272, thereby adjusting the direction of the lasers to the left relative to the main housing section 160, and, in turn, relative to the barrel of the weapon to which the unit is attached.

Rotation of the barrel 324 in the other direction causes the bearing member to move away the laser bench 148. The resilient or yielding nature of the vertical web 232 allows the bench 148 to pivot about the axis of the vertical web toward the bearing member due to the spring force of the spring 272, thereby adjusting the direction of the lasers to the right relative to the main housing section 160, and, in turn, relative to the barrel of the weapon to which the unit is attached.

The outward facing end of the barrel 324 further includes a slot 328 or other features 332 for engaging a tool for effecting rotation of the barrel 324 relative to the sleeve 320. An O-ring or gasket 336 provides a sealing engagement between the barrel 324 and an inner wall of the sleeve 320 for preventing the ingress of water or other contamination into the interior of the housing.

A detent mechanism includes balls 340 and springs 344 received within openings 348 in the side of the detent section 295 of the barrel 324. The balls are aligned with a scalloped surface 352 defining a plurality of axially extending grooves on the inner surface of the scalloped section 294 of the sleeve 320. The grooves may be placed at periodic angular intervals about the inner surface of the sleeve to provide to provide an audible and/or tactile click and positive retention at each angular position. In a preferred embodiment, the scalloped surface may comprise 24 grooves to provide a click and positive retention at every 15 degrees of rotation of the barrel 324.

Figure 2:
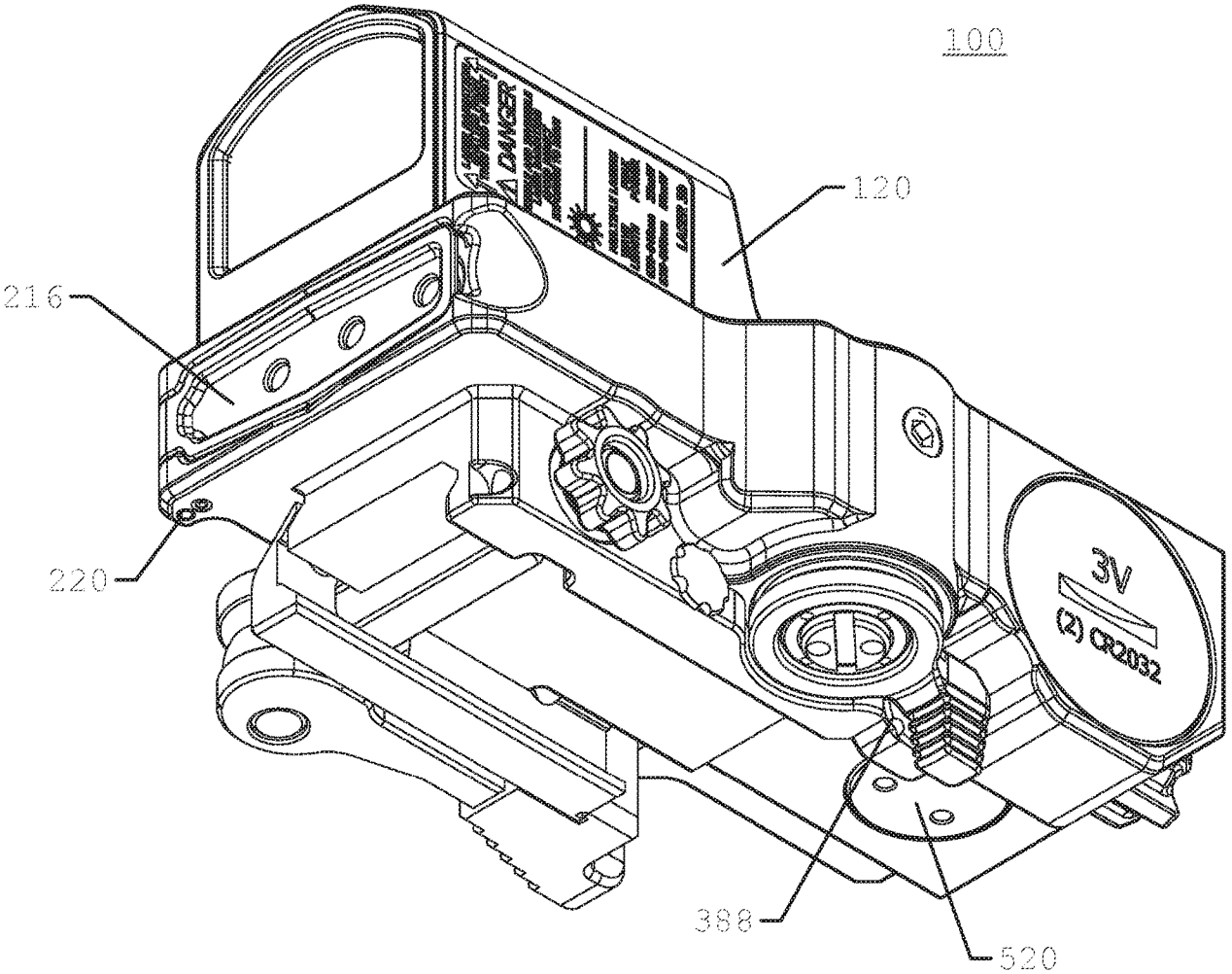
FIG. 2 is an isometric view of the sight appearing in FIG. 1, taken generally from below, the front, and the right side.
Figure 3:
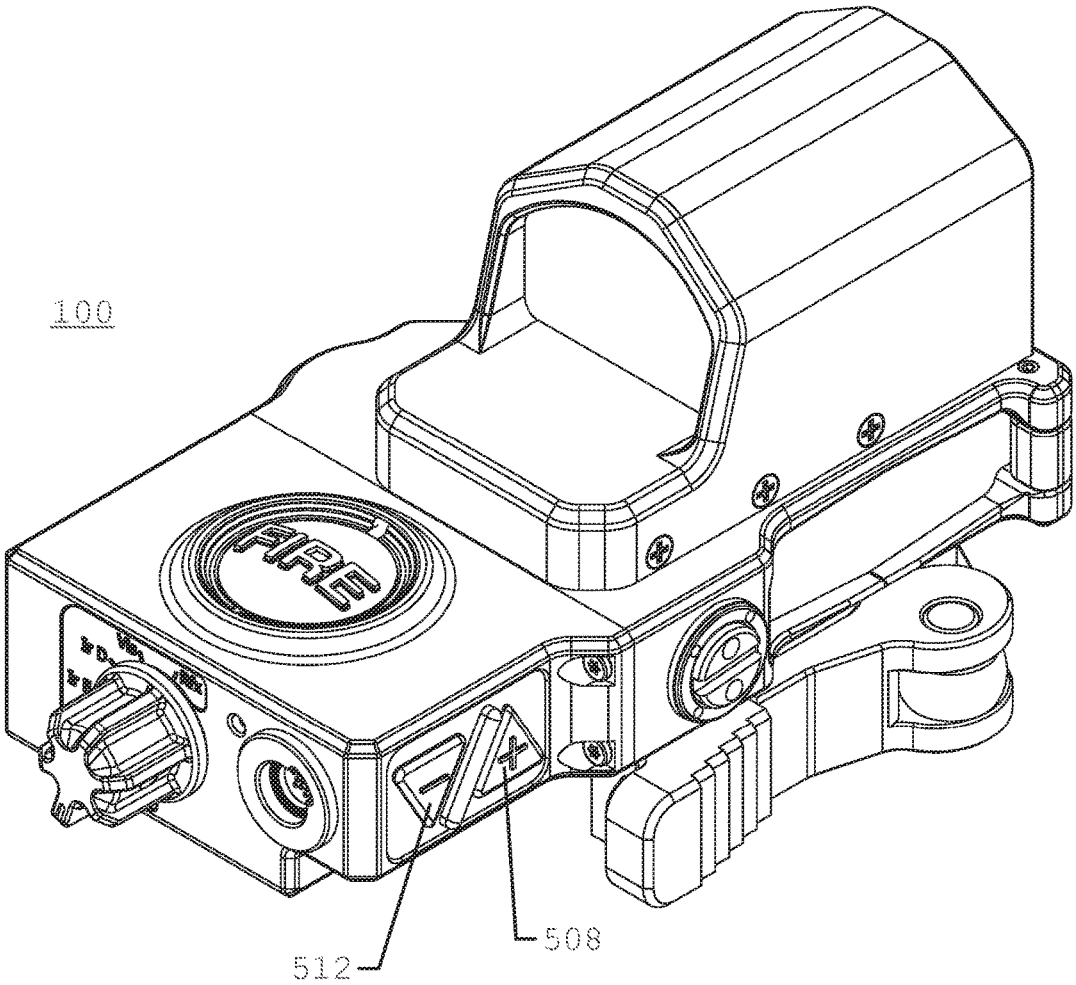
FIG. 3 is an isometric view of the sight appearing in FIG. 1, taken generally from above, the rear, and the left side.
Figure 4:
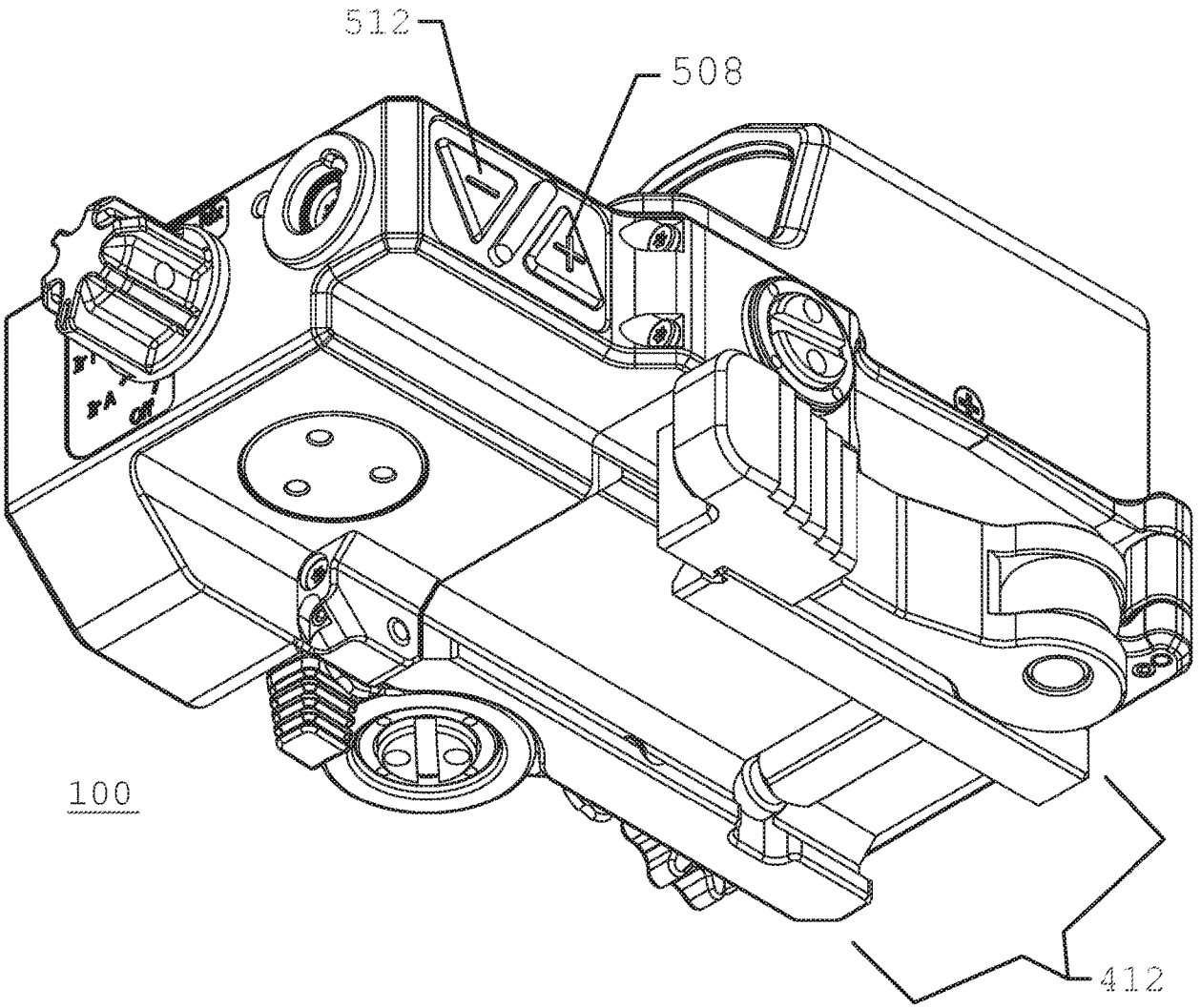
FIG. 4 is an isometric view of the sight appearing in FIG. 1, taken generally from below, the rear, and the left side.

With reference again to FIGS. 6 and 13, the sleeve 284 of the elevation micro-adjustment assembly 264 is received within an opening 364 within an elevation macro-adjustment lever ring 368. The elevation macro-adjustment lever ring 368, in turn, rotatably engages a receiving ring 372 received within an opening in the main housing section 160. The lever ring 368 includes a helical thread or cam surface which engages a complementary thread or cam follower on the receiving ring 372. The lever ring 368 includes a lever portion 384 for manually rotating the lever ring 368 from the first position (as shown in FIG. 2) to the second position, approximately 180 degrees from the first position. Rotation of the lever ring 368 approximately 180 degrees in a first direction causes an axial, downward translation of the entire micro-adjustment assembly 264 by some prespecified amount, thereby effecting an upward adjustment of the lasers on the target due to the yielding nature of the horizontal web 252. Rotation of the lever ring 368 approximately 180 degrees in the opposite direction causes an axial, upward translation of the entire micro-adjustment assembly by the previously mentioned prespecified amount, thereby effecting a downward adjustment of the lasers on the target. In certain embodiments, the lever ring 368 is interchangeable with one or more like lever rings having a helical thread or cam surface with a different pitch to effect a different macro elevation adjustment for different rounds, distances, or ballistics scenarios. In certain embodiments, a modular system is provided which includes a plurality of interchangeable lever rings 368 of different pitch.

The pitch of the cam surface in the lever ring 368 is selected to effect the desired upward and downward aiming of the laser to be effected by rotating the lever ring 368 180 degrees. Adjustable stops 388 are provided at each end of the throw of the lever 384. The stops 388 each comprise a threaded rod 392 rotatably received within threaded openings 396 in the main housing section 160. By rotating the stops 388 to selectively advance or retract them, the ends of the throw of the lever can be adjusted to provide precise control over the macro-adjustment effected by the lever ring 368. In the illustrated embodiment, the threaded rod portions include axial grooves or flutes 400 angularly spaced about the rods 392. In the illustrated embodiment, the flutes are spaced at 90-degree intervals about the rods 392.

Captured detent balls 404 are urged into the openings 396 by springs 408 and engage the flutes 400 as the stops 388 are rotated. The ball detent mechanism provides an audible and/or tactile click as the stops are rotated and provide positive retention of the stops at the desired position. Set-screws 410 retain the balls within the openings and can be rotated to adjust the spring force exerted on the balls 404.

In the illustrated embodiment, a rail clamp assembly 412 includes a fixed clamp member 416 and an opposing, movable clamp member 420. The fixed clamping member is rigidly secured to the lower surface of the main housing section 160, and may be integrally formed therewith (e.g., via a molding and/or machining process) or may be separately formed and permanently attached thereto. Each of the clamping members 412, 416 are configured to engage a weapon accessory rail tactical rail as are known in the art. The clamping members are preferably configured to securely engage an accessory rail in accordance with a promulgated standard including, without limitation, MIL-STD 1913, STANAG 2324, STANAG 4694, and the like.

The rail clamp assembly 412 further includes a lever 424 pivotally attached to a drawbar 428 via a pivot pin 432. The drawbar 428 passes through an opening 436 in the moveable clamp member 420 and an opening 440 in the fixed clamp member 416. A thumbscrew 444 rotatably engages the end of the drawbar opposite the lever 424. The lever 424 includes one or more cam surfaces 448 defined by a rounded, proximal end 452 of the lever 424. The one or more cam surfaces 448 bear against the outer surface of the movable clamp member 420. The pivot axis of the pin 432 passes through the rounded proximal end 452 of the lever 424 at a position offset from the center such that rotation of the lever to the closed position (see, e.g., FIG. 3) moves the pivot axis of the pin 432 away from the movable clamping member 420 to exert a clamping force and rotation of the lever from the closed position to the open position moves the pivot axis of the pin 432 toward the movable clamping member 420 to release the clamping force.

The thumbscrew 444 is selectively advanced or retracted when the lever is in the open position to adjust the effective length of the drawbar 428, as necessary to achieve a desired clamping force when the lever 424 is pivoted to the closed position. In preferred embodiments, the lever preferably includes a latching or securing means to prevent inadvertent releasing of the lever 424. In the illustrated embodiment, the lever 424 includes a latching member 456 slidably attached to the distal end which is slidable in the axial direction 460 toward and away from the proximal end 452. The latching member 456 includes a tongue 464, which engages a complimentary groove 468 formed in the movable clamping member 420 when the lever is in the closed position, and the latch member 456 is slid toward the proximal end 452. To release the lever 424, the moveable member 456 is first slid away from the proximal end 452 and then the lever 424 is pivoted about the pivot pin 432 to the open position.

The drawbar 428 is received within a transverse channel 472 (see FIG. 9) formed in the fixed clamping member and protrudes downward into the channel 476 defined between the clamping members 416, 420. The drawbar 428 protruding portion has a width that matches the width of the transverse recoil grooves in the accessory rail (not shown).

The protruding portion of the drawbar 428 is sized to be securely received within a selected one of the recoil grooves on the accessory rail to prevent axial movement of the unit 100 relative to the barrel of the weapon, e.g., due to recoil of the weapon when a round is fired.

A rear housing section 480 is attached to the front housing section 160 and houses electronic and electrical components, including a power supply, switches, connectors, and processing or control electronics for controlling operation of the light sources. A battery compartment 484 includes a removable cover 488 and houses one or more batteries or battery packs for operating the lasers 176*a*, 176*b*, 176*c*, the light source 122, and the associated electronics for controlling operation of the light sources.

Figure 11:
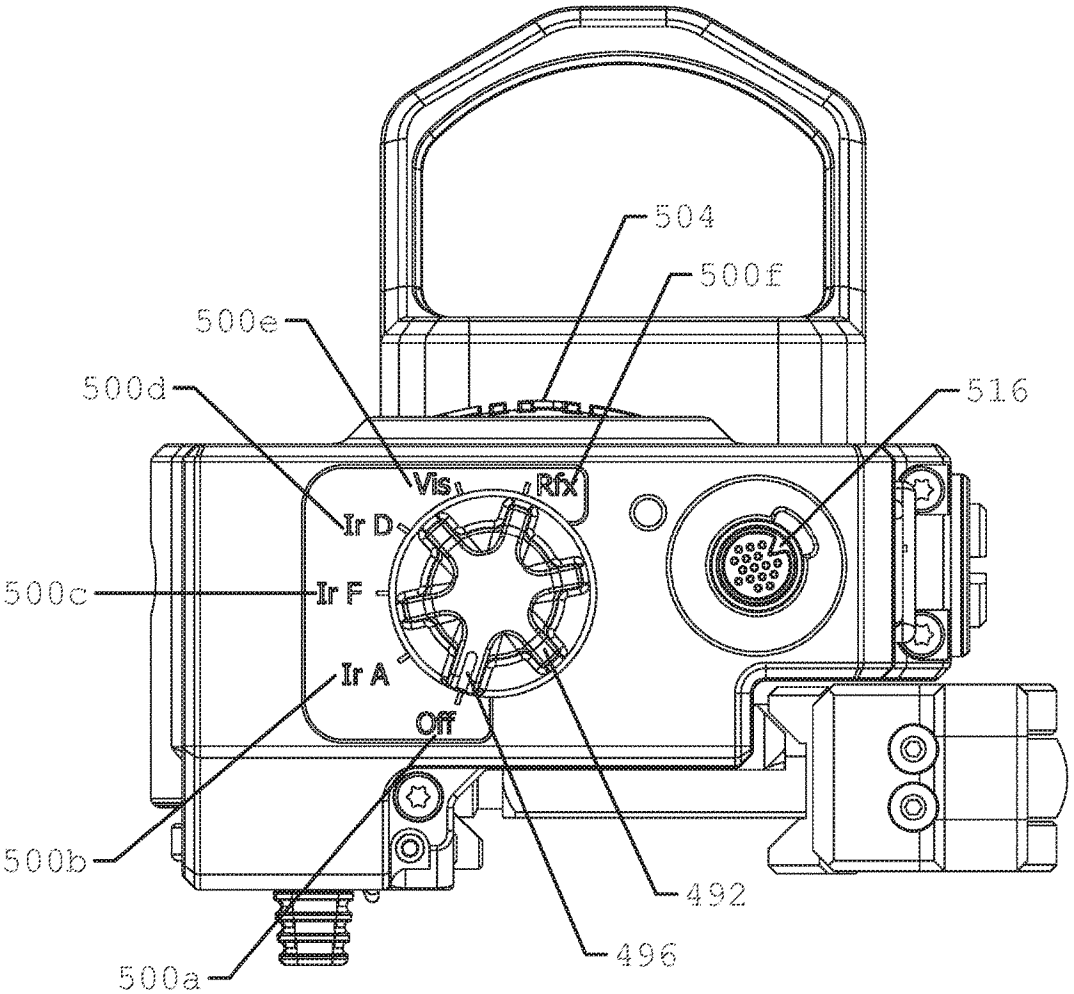
FIG. 11 is a rear elevational view of the sight appearing in FIG. 1.

As best seen in FIG. 11, a light source selector knob 492, which may be a rotary selector switch, is rotatable to select a desired light source or mode of operation, e.g., by aligning an indicium 496 on the knob 492 with a selected one of the indicia 500*a*-500*f* on the rear housing section 480. An actuator or "Fire" switch 504 actuates a selected one or more of the light sources, depending on the position of the selector knob 492. In some embodiments, the actuator switch 504 operates as a toggle switch, e.g., to turn on the selected source(s) in response to a first button press event and turn off the selected source(s) in response to a second button press event. In some embodiments, the actuator switch 504 operates as a momentary contact or press-and-hold switch, e.g., to turn on the selected source(s) in response to a button down event and turn off the selected source(s) responsive to a button up event.

In further embodiments, the switch 504 is capable of multiple modes of operation based on combinations of button presses and/or holds, such as press-and-hold, tap, double tap, and so forth. In preferred embodiments, a single button press event operates the selected source(s) in a press-and-hold mode and a double press event operates that the selected source(s) in a toggle mode. In such embodiments, the selected source(s) are powered on in response to a single button down event, remains on for as long as the user continues to hold down the button 504, and the selected source(s) are powered off when the button is released. In such embodiments, the selected source(s) are powered on in in toggle mode response to a button double tap, e.g., two button press events within some prespecified and preferably relatively short time period. In response to a double tap, the selected source(s) are powered on and remain until the user presses the button 504.

The selector knob 492 is used to select the source(s) that are operated by the button 504. Indicium 500*a* ("Off") corresponds to the off position wherein the unit 100 is powered down and no light sources will be activated by the button 504. Indicium 500*b* ("Ir A") corresponds to the IR aiming or pointing laser 176*a* which is operated by the button 504 in this configuration. Indicium 500*c* ("Jr F") corresponds to the IR flood laser 176*b* which is operated by the button 504 in this configuration. Indicium 500*d* ("Jr D") corresponds to the dual IR mode wherein both the IR aiming laser 176*a* and the IR flood laser 176*b* are operated simultaneously by the button 504. Indicium 500*e* ("Vis") corresponds to the visible wavelength aiming or pointing laser 176*c* which is operated by the button 504 in this configuration. Indicium 500*f* ("Rfx") corresponds to the reflex sight 110 and the reflex light source 122 is operated by the button 504 in this configuration.

Intensity increment button 508 and intensity decrement button 512 are provided to increase and decrease, respectively, the intensity output of the laser light sources. An electrical connector 516 may be provided and allows a remote control button, keypad, pressure pad, etc., to be electrically coupled to the unit 100. For example, the connector 516 may be provided to electrically couple to the unit 100, via a cabled connection, a switch mounted elsewhere on the weapon or a switch on another accessory attached to the weapon, such as a handgrip having a manual electrical switch thereon.

A programming port 520 may be provided to provide an interface to a computer system, e.g., to allow programming or updating/reprogramming of the software, firmware, or other control electronics.

Referring now to FIGS. 16-23, there appears a second embodiment of a combined aiming and reflex sight 200 which includes a reflex sight assembly 110 and a laser sight assembly 112*a*.

The reflex sight assembly 110*a* includes a light source to provide a reticle 113 superimposed upon a target field of view and is generally as described above by way of reference to the reflex sight assembly 110 appearing in FIGS. 1-15. The reflex sight assembly 110*a* interfaces with an optical bench 148*a* carrying three coaligned lasers 176*a*, 176*b*, 176*c* within a front laser housing module 160*a* of the laser sight assembly 112*a*. The laser sight assembly 112*a* is similar to the laser sight assembly 112 as detailed above by way of reference to FIGS. 1-15, and may be generally as described above by way of reference to the laser, except that some of the components have been rearranged as described below. The laser configuration may be as detailed above, and in preferred embodiments the lasers 176*a*, 176*b*, 176*c* include two pointing lasers of different wavelengths, e.g., IR and visible lasers, and an illuminator or flood laser as detailed above.

Figure 21:
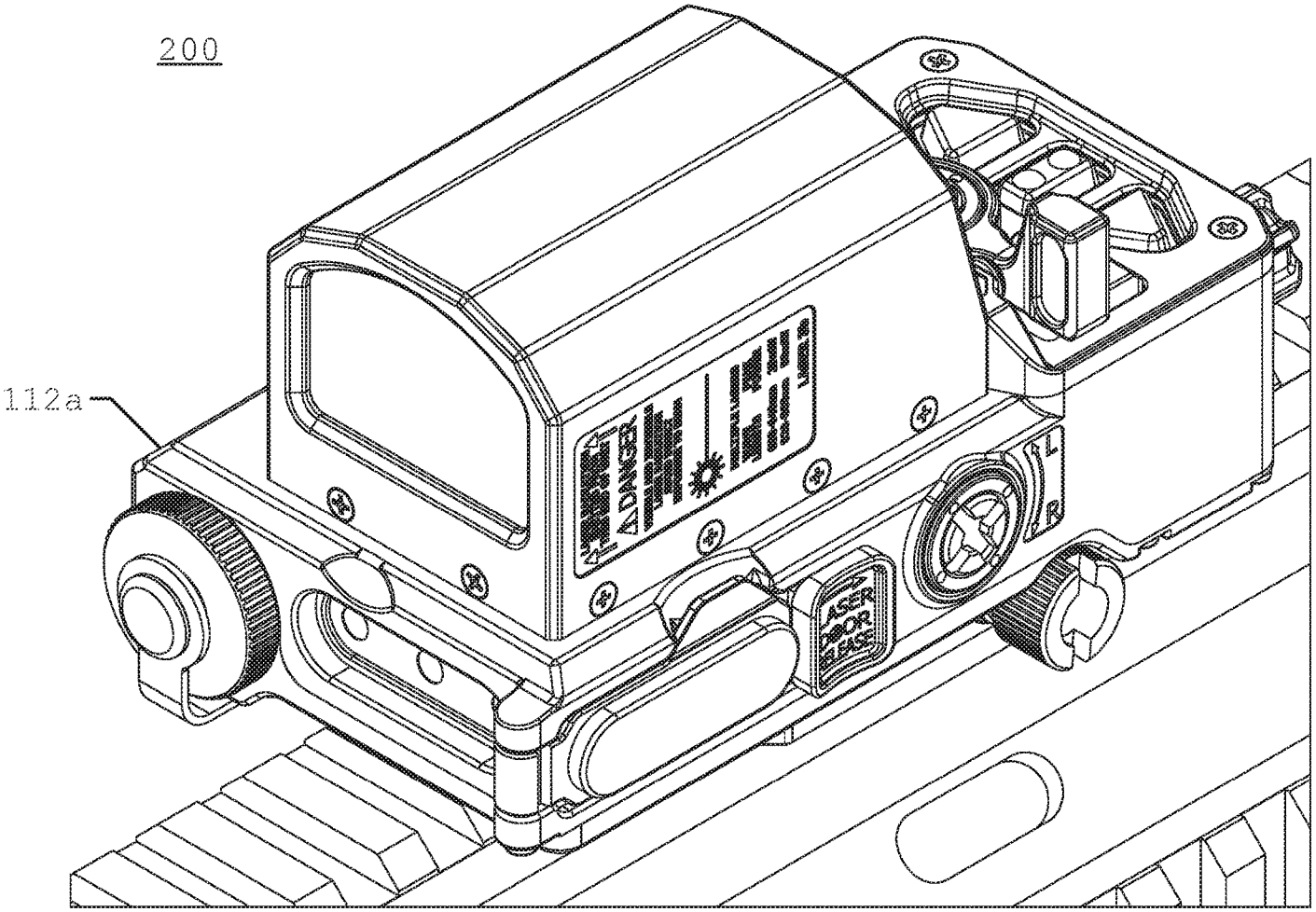
FIG. 21 is an isometric view of the sight appearing in FIG. 16, taken generally from the front and right side.

A hinged lens cover 216*a* is hingedly attached to the main front housing section 160*a* and may be as generally described above, except that the hinge 220*a* is disposed on the right side of the unit. The cover 216*a* carries three attenuators 224*a*, 224*b*, 224*c*, which are positioned in the optical path of the lasers when pivoted to the operative position (see e.g., FIG. 16). FIG. 21 illustrates the unit wherein the lens cover 216*a* is to the non-used position. The attenuators 224*a*, 224*b*, 224*c* may be optical filters that reduce the intensity of the laser beam to a level that is considered eye-safe, e.g., for use in training exercises. The main housing 160*a* and the hinged cover 216*a* may have complementary features, such as snap fit features, to provide positive retention of the cover in both the open and closed positions. A pivot block providing two degrees of pivoting or rotational freedom is as described above by way of reference to the pivot block 204 and provides an interface between the optical bench 148*a* and the housing 160*a*.

Figure 23:
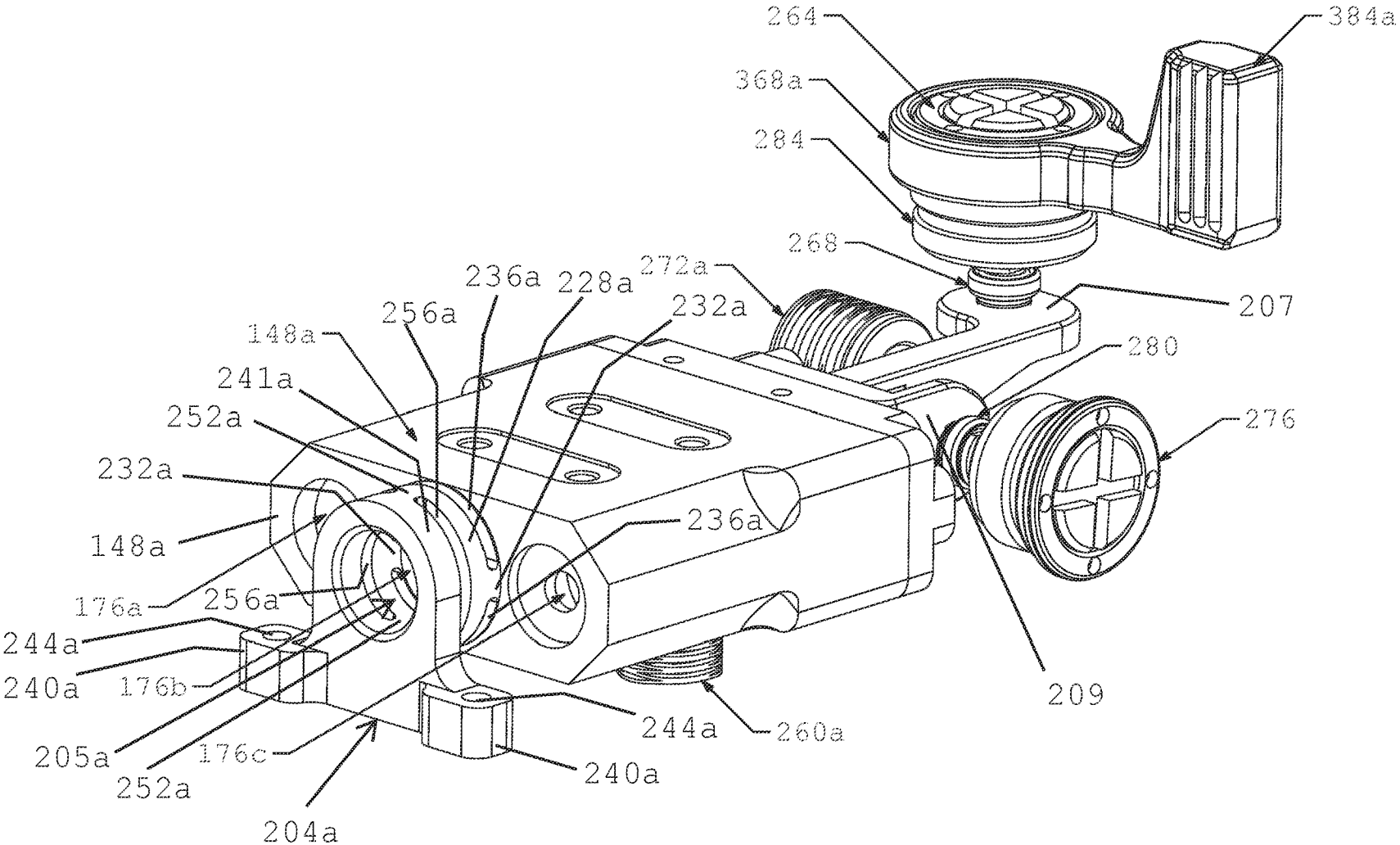
FIG. 23 is a front elevational view of the sight appearing in FIG. 16 with the housing removed.

As best seen in FIG. 23, an upward vertical force is exerted on the laser bench 148*a* by a first spring 260*a* bearing against a lower surface of the bench 148*a*, thereby tending to urge the rearward end of the laser bench 148*a* upward. An elevation micro-adjustment assembly 264 includes a bearing member 268, which bears against an upper surface of the laser bench 148*a*, opposing the urging of the first spring 260*a*.

A rightward vertical force is exerted on the laser bench 148*a* by a second spring 272*a* bearing against a left side surface of the bench 148*a*, thereby tending to urge the rearward end of the laser bench 148*a* to the right. A windage adjustment assembly 276 includes a bearing member 280 which bears against a left side surface of the laser bench 148*a*, opposing the urging of the second spring 272*a*. Except with respect to the positions with respect to the optical bench, the elevation micro-adjustment assembly 264 and the windage micro-adjustment assembly 276 are as described above by way of reference to FIGS. 6, 13, and 14, which description is equally applicable and incorporated here.

The laser bench 148*a* has a mounting block 204*a* to providing a flexible connection between the housing and the optical bench 148*a*. The block 204*a* is secured to a forward facing surface of the bench 148*a* at a central position. An aperture 205 is formed in the block 204*a* to define an optical path for the laser 176*b*. The block is secured to the housing via fasteners engaging openings 244*a* in mounting feet 240*a* formed on an outer ring 241.

The mounting block 204*a* may be an integrally formed part of the laser bench 148*a* and may be formed, for example, via a molding or machining process. Alternatively, the block 204*a* may be separately formed and attached to the front surface of the laser bench 148*a*. As best seen in FIG. 23, the block 204*a* includes an inner ring 228*a* spaced apart from the front surface of the bench 148*a* and connected thereto by a horizontal webs 232*a* extending between the bench 148*a* and a rearward facing surface of the inner ring 228*a* on opposing transverse sides of the aperture 205. The horizontal webs 232*a* are generally aligned with a horizontal centerline of the ring 228*a* and two horizontally extending channels 236*a* are defined on opposite sides of the horizontal webs 232*a*. The horizontal webs 232*a* are resilient, allowing the bench 148 to pivot about a horizontal pivot axis passing through the vertical webs 232*a*.

The block 204*a* further includes the outer ring 241, which is spaced apart from the inner ring 228*a* and is connected by vertical webs 252*a*. A pair of channels 256*a* vertically extend on opposite sides of the vertical webs 256*a* between the facing surfaces of the inner ring 228*a* and the outer ring 241. The vertical webs 252*a* are generally aligned with a vertical centerline of the inner ring 228*a*. The vertical webs 252*a* are resilient, allowing the bench 148*a* to pivot about an axis passing through the vertical webs 252*a*.

The resiliency of the horizontal webs 232*a* allows the laser bench 148*a* to yield in response to a vertical force exerted on the laser bench 148*a*, thereby allowing the alignment of the laser bench 148*a* to be adjusted relative to the front main housing, thus providing a vertical adjustment of the laser beams emitted by the lasers 176*a*, 176*b*, 176*c*. The vertical forces acting on the optical bench include a downward force exerted by the bearing member 268 of the elevation adjust assembly 264 upon a lever arm 207 and an upward force exerted on the lower surface of the optical bench 148*a* by the spring member 260*a*.

Likewise, the resiliency of the vertical webs 252*a* allows the laser bench 148*a* to yield in response to a horizontal force exerted on the laser bench 148*a*, thereby allowing the alignment of the laser bench 148*a* to be adjusted relative to the main housing, thus providing a side-to-side adjustment of the laser beams emitted by the lasers 176*a*, 176*b*, 176*c*. The horizontal forces acting on the optical bench include a transverse force exerted upon a lever 209 by the bearing member 280 of the windage adjust assembly 276 and an opposing transverse force exerted by the spring member 272*a* n the lever 207.

Figure 17:
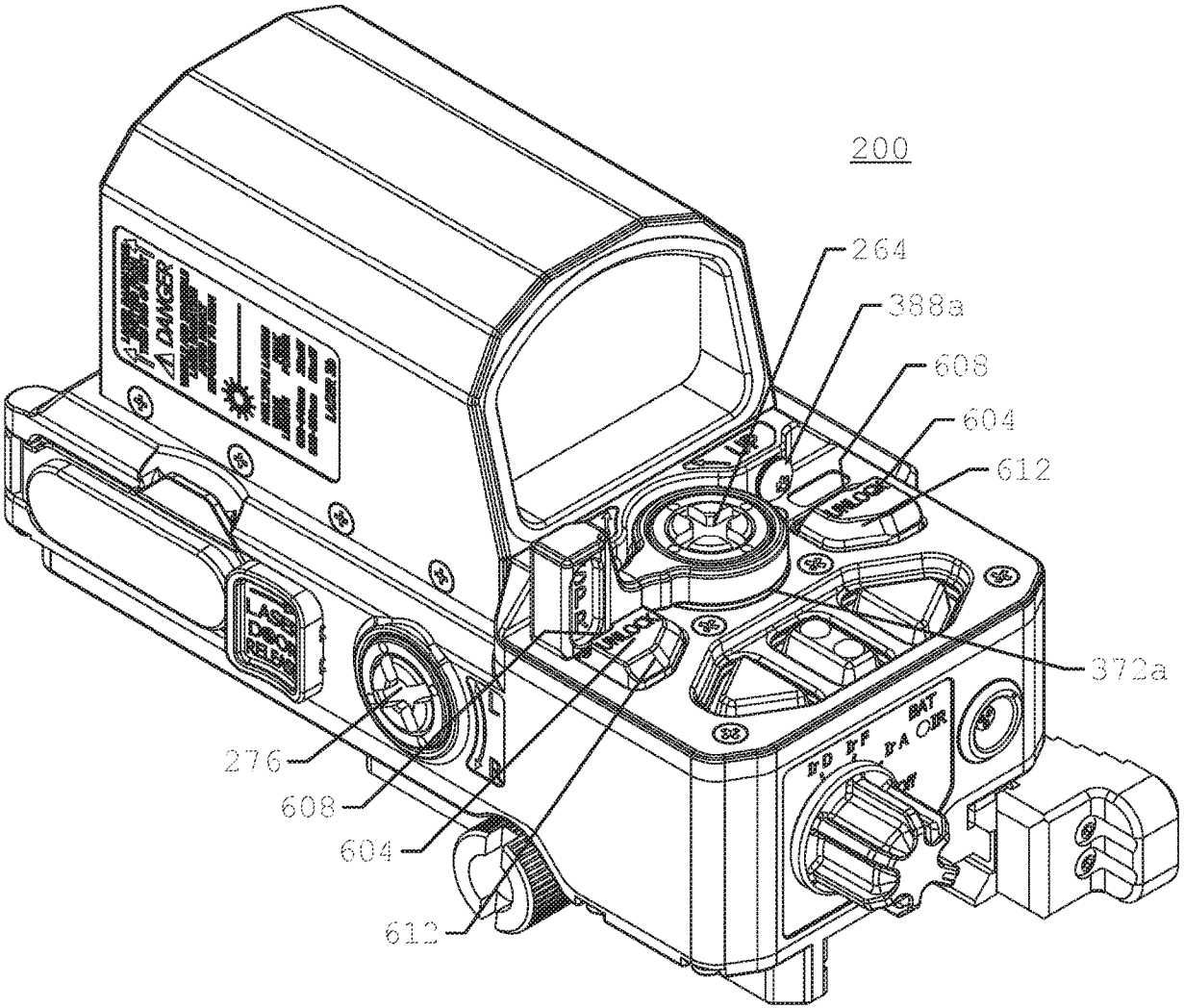
FIG. 17 is an isometric view of the sight appearing in FIG. 16, taken generally from above, the rear, and the right side.
Figure 18:
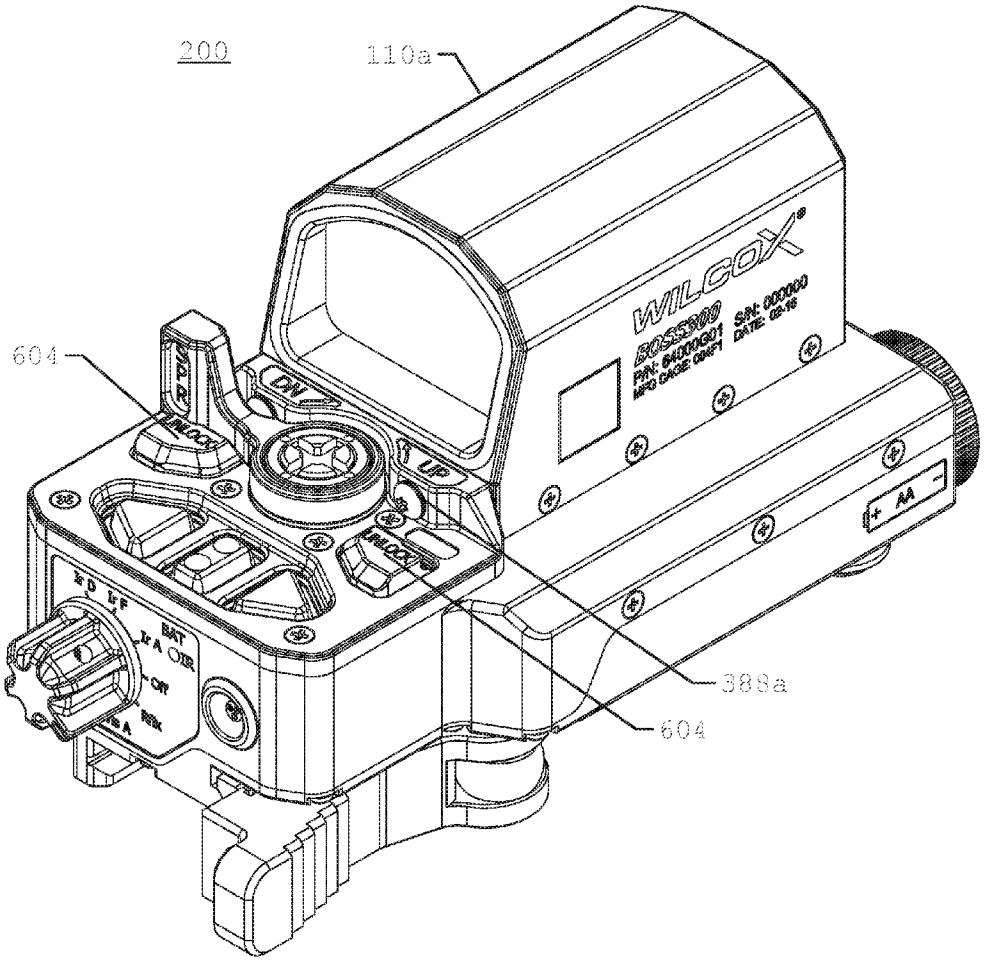
FIG. 18 is an isometric view of the sight appearing in FIG. 16, taken generally from above, the rear, and the left side.
Figure 19:
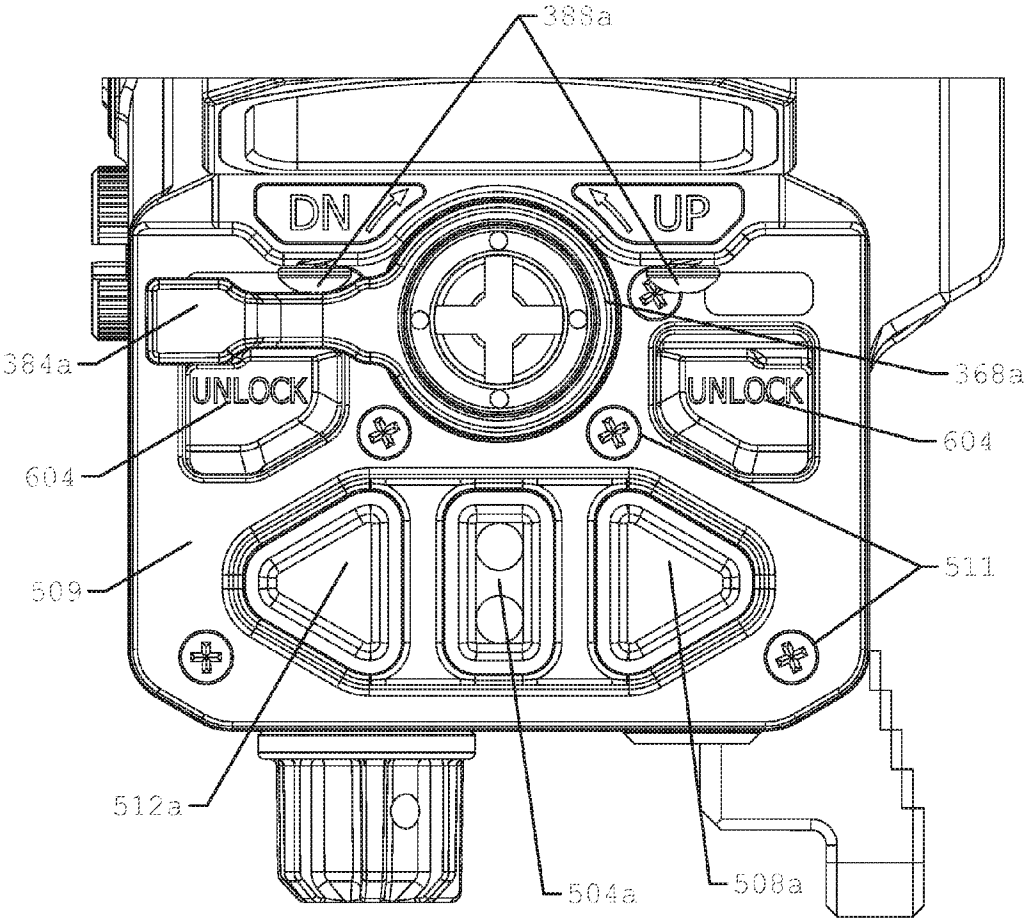
FIGS. 19 and 20 are fragmentary top views of the sight appearing in FIG. 16 with the macro-adjustment lever in the first and second positions.
Figure 20:
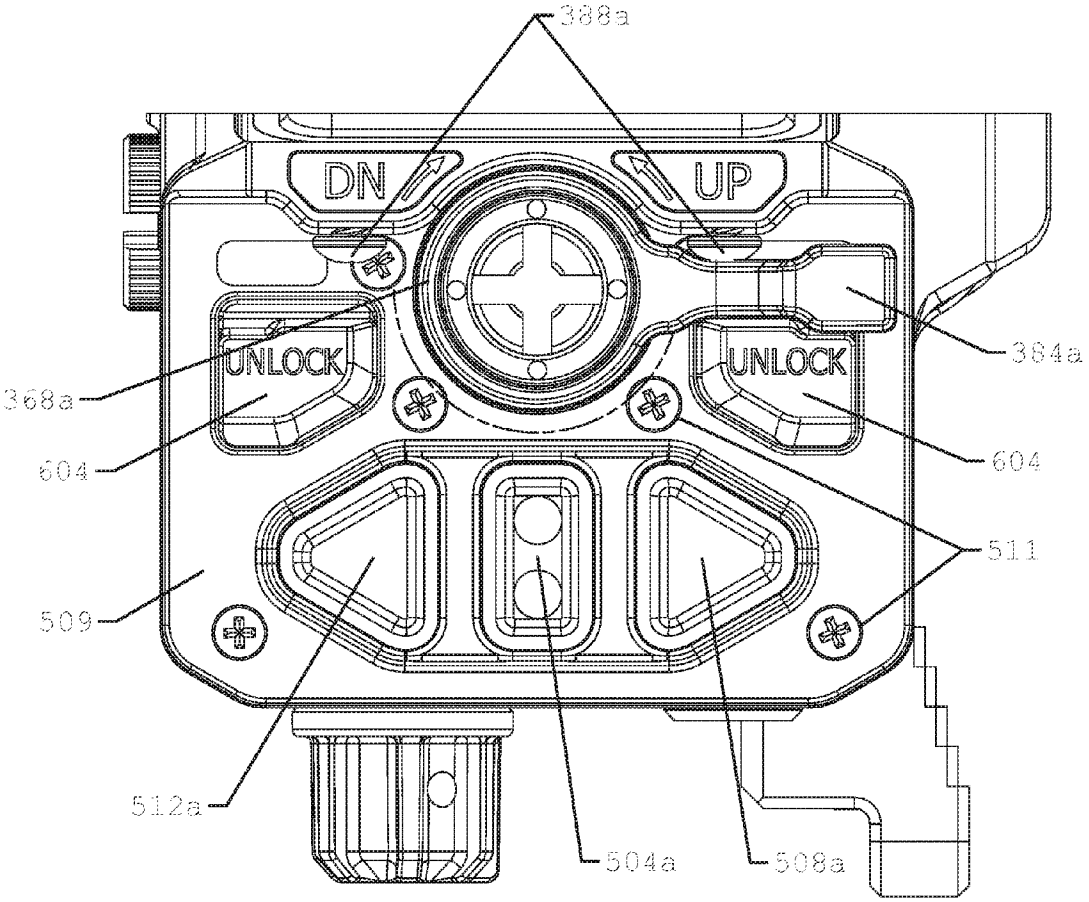

The sleeve 284 of the elevation micro-adjustment assembly 264 is received within an opening in an elevation macro-adjustment lever ring 368*a*. The elevation macro-adjustment lever ring 368*a*, in turn, rotatably engages a complementary receiving ring 372*a* received within an opening in the main housing section 160*a*. The lever ring 368*a* includes a helical thread or cam surface which engages a complementary thread or cam follower on the receiving ring 372*a*. The lever ring 368*a* includes a lever portion 384*a* for manually rotating the lever ring 368*a* from the first position (as shown in FIGS. 17 and 19) to the second position, approximately 180 degrees from the first position (as shown in FIGS. 18 and 20). Rotation of the lever ring 368*a* approximately 180 degrees in a first direction causes an axial, downward translation of the entire micro-adjustment assembly 264 by some prespecified amount, thereby effecting an upward adjustment of the lasers on the target due to the yielding nature of the horizontal web 252 (see FIG. 2). Rotation of the lever ring 368*a* approximately 180 degrees in the opposite direction causes an axial, upward translation of the entire micro-adjustment assembly by the previously mentioned prespecified amount, thereby effecting a downward adjustment of the lasers on the target.

In certain embodiments, the lever ring 368*a* is interchangeable with one or more like lever rings having a helical thread or cam surface with a different pitch to effect a different macro elevation adjustment for different rounds, distances, or ballistics scenarios. In the illustrated preferred embodiment, the lever ring 368*a* is rotatably carried on an upper housing plate 509 which is secured to the unit 200 via a plurality of threaded fasteners 511. Removal of the fasteners 511 allows the plate 509 and the lever ring 368*a* to be removed and exchanged with a like plate 509 carrying a lever ring 368*a* having a different helical pitch to cause the lever ring 368*a* to effect a second prespecified amount corresponding to a desired ballistic compensation corresponding to a different shooting scenario such as distance to target, elevational difference between the target and shooting position, type of munition round being fired, and the like. In certain embodiments, a modular system is provided which includes a plurality of interchangeable plates 509 each having a lever rings 368*a* of different pitch.

The pitch of the cam surface in the lever ring 368*a* is selected to effect the desired upward and downward aiming of the laser to be effected by rotating the lever ring 368*a* 180 degrees. Adjustable stops 388*a* are provided at each end of the throw of the lever 384*a*. The stops 388*a* each comprise a threaded shaft rotatably received within complementary threaded openings in the main housing section 160*a*. By rotating the stops 388*a* to selectively advance or retract them, the ends of the throw of the lever can be adjusted to provide precise control over the macro-adjustment effected by the lever ring 368. In certain embodiments, the threaded rod portions include axial grooves or flutes angularly spaced about the threaded shaft, e.g., at 90-degree intervals, although other spacings are contemplated. Captured detent balls and springs may be provided to provide an audible and/or tactile click as the stops 388*a* are rotated to provide positive retention of the stops at the desired position in the same manner as detailed above by way of reference to FIG. 6. The angular spacing of the flutes on the threaded shaft, the pitch of the thread on the threaded shaft, and the distance of the stops 388*a* from the axis of rotation of the lever ring 368*a* can be selected so that each partial rotation of click of the stops 388*a* corresponds to a known angular adjustment of the optical bench 148*a*.

A pair of unlock buttons 604 is disposed on the upper surface of the rear housing cover 480*a*. The buttons 604 are downwardly depressible against the bias of internal captured springs or other resilient members. The buttons 604 protrude above the surface of the housing cover 480*a* and are disposed adjacent each end of the throw range of the lever

384*a*. Each of the buttons 604 includes a relatively steep, e.g., generally vertical forward facing surface 608 which faces the lever 384*a* when the lever 384*a* is at the respective end of its throw range. Each of the buttons 604 also includes a ramped or inclined rearward facing surface 612 on the opposite side.

The captured springs urge the button 604 into the path of the lever 384*a*. Given the vertical or steep angle of the surface 608, the surface 608 acts as a stop to prevent movement of the lever out of the locked position unless the user manually depresses the button 604 to move it out of the path of the lever 384*a*. However, once the lever 384*a* is moved past the button 604 to a position intermediate the two locked positions, the sloping surfaces 612 allow sliding movement of the lever 384*a* over the respective button 604, i.e., wherein the ramped surface 612 causes the button 604 to be depressed as the lever is moved from an unlocked position to a locked position.

Referring now to FIGS. 1-15 and with continued reference to FIGS. 16-23, the presently disclosed elevation macro-adjustment mechanisms employ a precisely controlled pitch of the cam surface and/or the throw range of the rotating lever ring 368, 368*a* to provide a relatively large yet precise elevational adjustment to the angle of the respective sight 100, 200 relative to the barrel of an attached weapon. The elevation macro-adjustment feature of the present disclosure is particularly advantageous in that it allows the weapon to be rapidly sighted in for different shooting scenarios. For example, it may be desirable to use different types of ammunition rounds having different ballistics properties in the same weapon. One such example of a weapon capable of firing rounds having significantly different ballistics properties is the M4 carbine, which is capable of firing both standard or low velocity (subsonic) rounds and high velocity (supersonic) rounds such as 300 AAC Blackout rounds. Because the reflex sight and the lasers are all co-aligned, a single adjustment affects the alignment of the reflex sight and each laser equally.

For example, a shooter may select high velocity rounds when the performance of the high velocity rounds is desired. However, supersonic bullets create a supersonic shockwave, thus producing an audible "crack" as it travels, even in the case of a firearm employing a flash suppressor or so-called "silencer." As such, in scenarios where it is desired to reduce the sound produced when a round is fired, the shooter may switch to a subsonic round. Because the subsonic round has a greater ballistic drop than the high velocity round, the required alignment of the sight 100, 200 would be different for the high velocity rounds. In operation, the user first sights in the sight 110, 110*a* to the firearm with one type of round using with the micro-adjustment assemblies 264 and 276. The macro-adjustment then allows the sight 110, 110*a* to be realigned for the second type of round by simply pivoting the lever ring 368, 368*a* 180 degrees. The lever ring 368, 368*a* can further be fine-tuned using the stops 388, 388*a*, e.g., by advancing or retracting the stops in quarter turn increments. In this manner, the user can carry magazines containing each of the two types of ammunition and can switch between the two simply by changing magazines and flipping the lever.

Although the elevation macro-adjustment feature of the present disclosure is particularly advantageous for rapidly aligning the sight 100, 200 for use with different types of ammunition, it will be recognized that the elevation macro-adjustment feature present disclosure also finds utility in rapidly realigning the sight in other situations, including switching between long range shooting and close range shooting and elevational changes between the shooter's vantage point and the target. It will be recognized that the degree of vertical adjustment can be preselected by selecting the pitch of the cam surface or thread in the cam lever ring 368, 368*a*. In certain embodiments, a modular system is contemplated wherein the cam lever ring 368, 368*a* and/or the receiving ring 372, 372*a* are removable and exchangeable with alternative cam lever rings and/or receiving rings to provide different degrees of macro-adjustment.

With continued reference to the embodiment 200 illustrated in FIGS. 16-23, a rail clamp assembly 412*a* includes a fixed clamp member 416*a* and an opposing, movable clamp member 420*a*. The fixed clamping member 416*a* is rigidly secured to the lower surface of the main housing section 160*a*, and may be integrally formed therewith (e.g., via a molding and/or machining process) or may be separately formed and permanently attached thereto. Each of the clamping members 416*a*, 420*a* are configured to engage a weapon accessory rail tactical rail 417 as are known in the art. The clamping members are preferably configured to securely engage an accessory rail in accordance with a promulgated standard including, without limitation, MIL-STD 1913, STANAG 2324, STANAG 4694, and the like.

The rail clamp assembly 412*a* further includes a lever 424*a* pivotally attached to a drawbar 428*a* via a pivot pin 432*a*. The drawbar 428*a* passes through respective openings in the moveable clamp member 420*a* and the fixed clamp member 416*a*. A thumbscrew 444*a* rotatably engages the end of the drawbar 428*a* opposite the lever 424*a*. The lever 424*a* includes one or more cam surfaces, e.g., as defined by an eccentric or off-center opening in a rounded, proximal end 452*a* of the lever 424*a*, wherein pivoting movement of the lever causes the pivot axis to move toward or away from the movable clamping member to selectively apply and release a clamping force as detailed above by way of description of the rail clamp lever 412.

The thumbscrew 444*a* is selectively advanced or retracted when the lever is in the open position to adjust the effective length of the drawbar 428*a*, as necessary to achieve a desired clamping force when the lever 424*a* is pivoted to the closed position. In preferred embodiments, the lever preferably includes a latching or securing means to prevent inadvertent releasing of the lever 424*a*, which latching mechanism may be as described above by way of reference to the rail clamp assembly 424 appearing in FIGS. 1-15.

In the illustrated embodiment, the drawbar 428*a* is received within a transverse channel formed in the fixed clamping member and protrudes downward, wherein the protruding portion is sized to be received a desired one of the transverse recoil grooves 419 in the accessory rail 417 to prevent axial movement of the unit 200 relative to the barrel of the weapon, e.g., due to recoil of the weapon when a round is fired, as detailed above.

A rear housing section 480*a* is attached to the front housing section 160*a* and houses electronic and electrical components, including a power supply, switches, connectors, and processing or control electronics for controlling operation of the light sources. A battery compartment 484*a* includes a removable cover 488*a* and houses one or more batteries or battery packs for operating the lasers 176*a*, 176*b*, 176*c*, the light source of the reflex sight 110*a*, and the associated electronics for controlling operation of the light sources.

Figure 22:
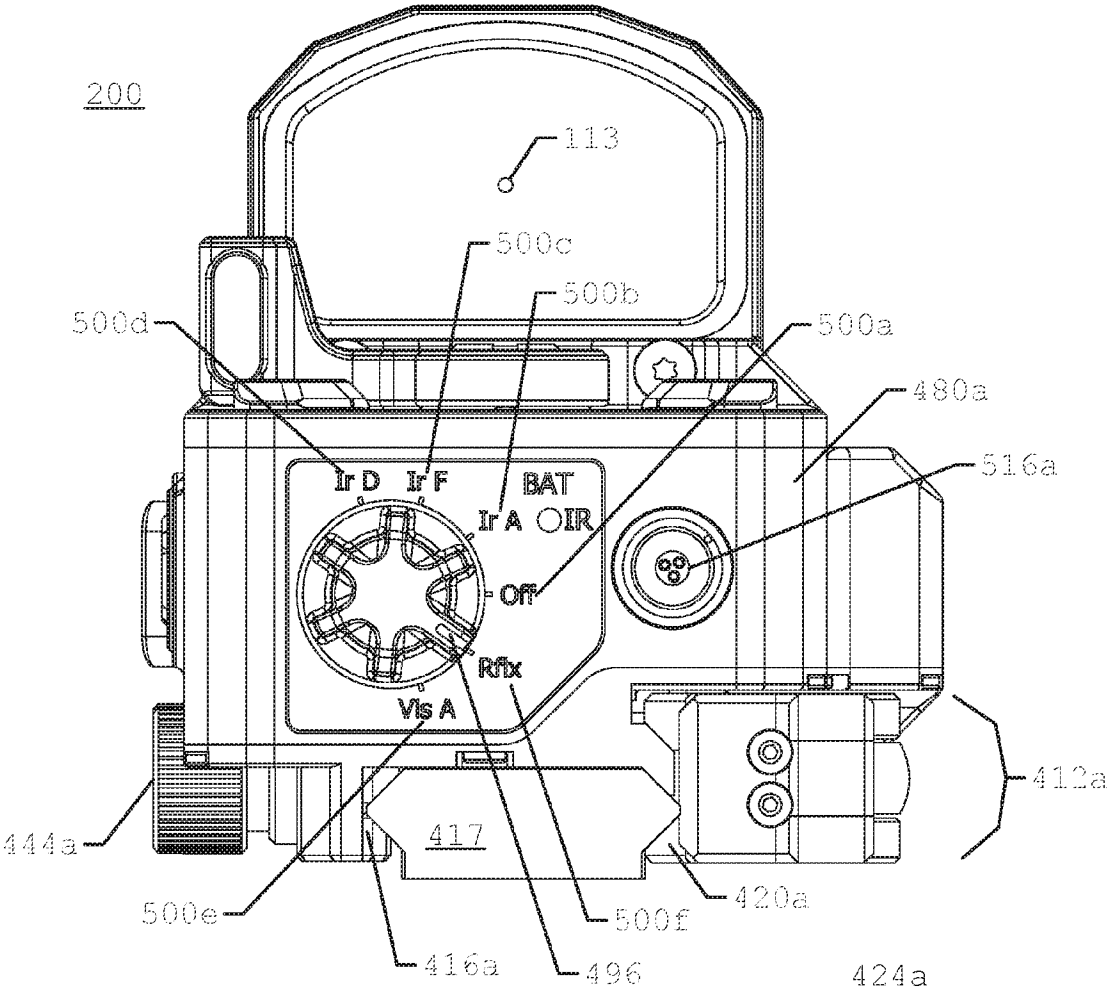
FIG. 22 is a rear elevational view of the sight appearing in FIG. 16.

As best seen in FIG. 22, a light source selector knob 492, which may be a rotary selector switch, is rotatable to select a desired light source or mode of operation, e.g., by aligning an indicium 496 on the knob 492 with a selected one of the indicia 500*a*-500*f* on the rear housing section 480*a*. An actuator or "Fire" switch 504*a* actuates a selected one or more of the light sources, depending on the position of the selector knob 492. In some embodiments, the actuator switch 504*a* operates as a toggle switch, e.g., to turn on the selected source(s) in response to a first button press event and turn off the selected source(s) in response to a second button press event. In some embodiments, the actuator switch 504*a* operates as a momentary contact or press-and-hold switch, e.g., to turn on the selected source(s) in response to a button down event and turn off the selected source(s) responsive to a button up event.

In further embodiments, the switch 504*a* is capable of multiple modes of operation based on combinations of button presses and/or holds, such as press-and-hold, tap, double tap, and so forth. In preferred embodiments, a single button press event operates the selected source(s) in a press-and-hold mode and a double press event operates that the selected source(s) in a toggle mode. In such embodiments, the selected source(s) are powered on in response to a single button down event, remains on for as long as the user continues to hold down the button 504*a*, and the selected source(s) are powered off when the button is released. In such embodiments, the selected source(s) are powered on in in toggle mode response to a button double tap, e.g., two button press events within some prespecified and preferably relatively short time period. In response to a double tap, the selected source(s) are powered on and remain until the user presses the button 504*a*.

The selector knob 492 is used to select the source(s) that are operated by the button 504*a*. Indicium 500*a* ("Off") corresponds to the off position wherein the unit 200 is powered down and no light sources will be activated by the button 504*a*. Indicium 500*b* ("Ir A") corresponds to the IR aiming or pointing laser 176*a* which is operated by the button 504*a* in this configuration. Indicium 500*c* ("Ir F") corresponds to the IR flood laser 176*b* which is operated by the button 504*a* in this configuration. Indicium 500*d* ("Ir D") corresponds to the dual IR mode wherein both the IR aiming laser 176*a* and the IR flood laser 176*b* are operated simultaneously by the button 504*a*. Indicium 500*e* ("Vis") corresponds to the visible wavelength aiming or pointing laser 176*c* which is operated by the button 504*a* in this configuration. Indicium 500*f* ("Rfx") corresponds to the reflex sight 110*a* and the reflex light source is operated by the button 504*a* in this configuration.

Intensity increment button 508*a* and intensity decrement button 512*a* are provided to increase and decrease, respectively, the intensity output of the laser light sources. An electrical connector 516*a* may be provided and allows a remote control button, keypad, pressure pad, etc., to be electrically coupled to the unit 200. For example, the connector 516*a* may be provided to electrically couple to the unit 200, via a cabled connection, a switch mounted elsewhere on the weapon, or a switch on another accessory attached to the weapon, such as a handgrip having a manual electrical switch thereon. A programming port may be provided to provide an interface to a computer system, e.g., to allow programming or updating/reprogramming of the software, firmware, or other control electronics.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

The invention claimed is:

1. An integrated sight for a weapon having a barrel for firing projectiles, the barrel defining a longitudinal bore axis, the integrated sight comprising:

(a) a housing having a front end configured to be positioned toward a front end of the weapon and a rear end configured to be positioned toward the rear end of the weapon;

(b) a fastener for removably attaching the housing to the weapon; and (c) a laser sight disposed within the housing, the laser sight comprising:

(1) an optical bench comprising at least one aperture positioned toward the front end of the housing;

(2) at least one laser tube disposed within the optical bench to emit a laser beam through the at least one aperture; and (3) a mounting block attaching the optical bench to an internal surface of the housing, wherein the mounting block includes a pair of vertically oriented channels separated by a vertically oriented, flexible web of material; and (d) a reflex sight attached to the housing, the reflex sight comprising:

(1) a base securely attached to the optical bench;

(2) a light source securely attached to the base; and (3) a lens assembly positioned frontward of the light source and configured to reflect a collimated light beam from the light source toward the rear end of the housing; and wherein the collimated light beam from the light source and the laser beam from the at least one laser tube are coaligned, and wherein the optical bench is rotationally adjustable within the housing about a first pivot axis and about a second pivot axis, wherein the longitudinal bore axis, the first pivot axis, and the second pivot axis are mutually orthogonal.

2. The integrated sight of claim 1, wherein the laser sight comprises an optical bench having three apertures positioned toward the front end of the housing and three laser tubes disposed within the optical bench to emit laser beams through an aligned one of the three apertures.

3. The integrated sight of claim 1, wherein the mounting block is integral with the optical bench.

4. The integrated sight of claim 1, wherein the mounting block is separately formed from the optical bench and attached thereto.

5. The integrated sight of claim 1, wherein mounting block includes a pair of horizontally oriented channels separated by a horizontally oriented, flexible web of material.

6. The integrated sight of claim 1, further comprising a lens cover comprising at least one attenuator, the lens cover being attached to the front end of the housing via a hinge that enables the lens cover to swing between a first secured position in which the at least one attenuator aligns with the at least one aperture and attenuates the laser beam emitted by the at least one laser tube and a second secured position in which the lens cover does not attenuate the laser beam emitted by the at least one laser tube.

7. The integrated sight of claim 1, further comprising a first adjustment mechanism for rotating the optical bench about the first pivot axis and a second adjustment mechanism for rotating the optical bench about the second pivot axis.

8. The integrated sight of claim 7, wherein at least one of the first adjustment mechanism and the second adjustment mechanism comprises:

(a) an assembly attached to the housing and a first surface of the optical bench, the assembly comprising:

(1) a barrel having an axis coincident with an adjustment axis of a first and second ring of an elevation macro-adjustment mechanism, the barrel comprising:

(i) a first section in contact with the optical bench movable portion of the laser sight;

(ii)a second section adjacent to the first section, the second section having a thread running circumferentially on an outer surface of the second section;

(iii) a third section adjacent to the second section, the third section having two openings positioned diametrically in an outer surface of the third section;

(iv) a spring and a ball bearing disposed in each of the openings of the outer surface of the third section, the spring disposed between the ball bearing and the axis of the barrel; and (v) a fourth section comprising at least one feature enabling rotation of the barrel; and (2) a sleeve capable of receiving the barrel, the sleeve comprising:

(i) a first section having a thread running circumferentially on an inner surface of the first section and capable of engaging the thread on the second section of the barrel; and (ii) a second section having a scalloped surface defining a plurality of axially extending grooves on an inner surface of the second section; and (b) a spring disposed between an internal surface of the housing and a second surface of the optical bench, the first and second surfaces being on opposite sides of the optical bench.

9. An integrated sight for a weapon having a barrel for firing projectiles, the barrel defining a longitudinal bore axis, the integrated sight comprising:

(a) a housing having a front end configured to be positioned toward a front end of the weapon and a rear end configured to be positioned toward the rear end of the weapon;

(b) a fastener for removably attaching the housing to the weapon; and (c) a laser sight disposed within the housing, the laser sight comprising:

(1) an optical bench comprising at least one aperture positioned toward the front end of the housing;

(2) at least one laser tube disposed within the optical bench to emit a laser beam through the at least one aperture; and (3) a mounting block attaching the optical bench to an internal surface of the housing, wherein mounting block includes a pair of horizontally oriented channels separated by a horizontally oriented, flexible web of material; and (d) a reflex sight attached to the housing, the reflex sight comprising:

(1) a base securely attached to the optical bench;

(2) a light source securely attached to the base; and (3) a lens assembly positioned frontward of the light source and configured to reflect a collimated light beam from the light source toward the rear end of the housing; and wherein the collimated light beam from the light source and the laser beam from the at least one laser tube are coaligned, and wherein the optical bench is rotationally adjustable within the housing about a first pivot axis and about a second pivot axis, wherein the longitudinal bore axis, the first pivot axis, and the second pivot axis are mutually orthogonal.

10. The integrated sight of claim 9, wherein the laser sight comprises an optical bench having three apertures positioned toward the front end of the housing and three laser tubes disposed within the optical bench to emit laser beams through an aligned one of the three apertures.

11. The integrated sight of claim 9, wherein the mounting block is integral with the optical bench.

12. The integrated sight of claim 9, wherein the mounting block is separately formed from the optical bench and attached thereto.

13. The integrated sight of claim 9, further comprising a lens cover comprising at least one attenuator, the lens cover being attached to the front end of the housing via a hinge that enables the lens cover to swing between a first secured position in which the at least one attenuator aligns with the at least one aperture and attenuates the laser beam emitted by the at least one laser tube and a second secured position in which the lens cover does not attenuate the laser beam emitted by the at least one laser tube.

14. The integrated sight of claim 9, further comprising a first adjustment mechanism for rotating the optical bench about the first pivot axis and a second adjustment mechanism for rotating the optical bench about the second pivot axis.

15. The integrated sight of claim 14, wherein at least one of the first adjustment mechanism and the second adjustment mechanism comprises:

(a) an assembly attached to the housing and a first surface of the optical bench, the assembly comprising:

(1) a barrel having an axis coincident with an adjustment axis, the barrel comprising:

(i)a first section in contact with the optical bench;

(ii) a second section adjacent to the first section, the second section having a thread running circumferentially on an outer surface of the second section;

(iii) a third section adjacent to the second section, the third section having two openings positioned diametrically in an outer surface of the third section;

(iv) a spring and a ball bearing disposed in each of the openings of the outer surface of the third section, the spring disposed between the ball bearing and the axis of the barrel; and (v) a fourth section comprising at least one feature enabling rotation of the barrel; and (2) a sleeve capable of receiving the barrel, the sleeve comprising:

(i)a first section having a thread running circumferentially on an inner surface of the first section and capable of engaging the thread on the second section of the barrel; and (ii) a second section having a scalloped surface defining a plurality of axially extending grooves on an inner surface of the second section; and (b) a spring disposed between an internal surface of the housing and a second surface of the optical bench, the first and second surfaces being on opposite sides of the optical bench.

16. An integrated sight for a weapon having a barrel for firing projectiles, the barrel defining a longitudinal bore axis, the integrated sight comprising:

(a) a housing having a front end configured to be positioned toward a front end of the weapon and a rear end configured to be positioned toward the rear end of the weapon;

(b) a fastener for removably attaching the housing to the weapon;

(c) a laser sight disposed within the housing, the laser sight comprising:

(1) an optical bench comprising at least one aperture positioned toward the front end of the housing;

(2) at least one laser tube disposed within the optical bench to emit a laser beam through the at least one aperture; and (3) a mounting block attaching the optical bench to an internal surface of the housing;

(d) a reflex sight attached to the housing, the reflex sight comprising:

(1) a base securely attached to the optical bench;

(2) a light source securely attached to the base; and (3) a lens assembly positioned frontward of the light source and configured to reflect a collimated light beam from the light source toward the rear end of the housing; and (e) a lens cover comprising at least one attenuator, the lens cover being attached to the front end of the housing via a hinge that enables the lens cover to swing between a first secured position in which the at least one attenuator aligns with the at least one aperture and attenuates the laser beam emitted by the at least one laser tube and a second secured position in which the lens cover does not attenuate the laser beam emitted by the at least one laser tube;

wherein the collimated light beam from the light source and the laser beam from the at least one laser tube are coaligned, and wherein the optical bench is rotationally adjustable within the housing about a first pivot axis and about a second pivot axis, wherein the longitudinal bore axis, the first pivot axis, and the second pivot axis are mutually orthogonal.

17. The integrated sight of claim 16, wherein the laser sight comprises an optical bench having three apertures positioned toward the front end of the housing and three laser tubes disposed within the optical bench to emit laser beams through an aligned one of the three apertures.

18. The integrated sight of claim 16, wherein the mounting block is integral with the optical bench.

19. The integrated sight of claim 16, wherein the mounting block is separately formed from the optical bench and attached thereto.

20. The integrated sight of claim 16, further comprising a first adjustment mechanism for rotating the optical bench about the first pivot axis and a second adjustment mechanism for rotating the optical bench about the second pivot axis.

21. The integrated sight of claim 20, wherein at least one of the first adjustment mechanism and the second adjustment mechanism comprises:

(a) an assembly attached to the housing and a first surface of the optical bench, the assembly comprising:

(1) a barrel having an axis coincident with an adjustment axis, the barrel comprising:

(i) a first section in contact with the optical bench;

(ii) a second section adjacent to the first section, the second section having a thread running circumferentially on an outer surface of the second section;

(iii) a third section adjacent to the second section, the third section having two openings positioned diametrically in an outer surface of the third section;

(iv) a spring and a ball bearing disposed in each of the openings of the outer surface of the third section, the spring disposed between the ball bearing and the axis of the barrel; and (v) a fourth section comprising at least one feature enabling rotation of the barrel; and (2) a sleeve capable of receiving the barrel, the sleeve comprising:

(i) a first section having a thread running circumferentially on an inner surface of the first section and capable of engaging the thread on the second section of the barrel; and (ii) a second section having a scalloped surface defining a plurality of axially extending grooves on an inner surface of the second section; and (b) a spring disposed between an internal surface of the housing and a second surface of the optical bench, the first and second surfaces being on opposite sides of the optical bench.

22. An integrated sight for a weapon having a barrel for firing projectiles, the barrel defining a longitudinal bore axis, the integrated sight comprising:

(a) a housing having a front end configured to be positioned toward a front end of the weapon and a rear end configured to be positioned toward the rear end of the weapon;

(b) a fastener for removably attaching the housing to the weapon;

(c) a laser sight disposed within the housing, the laser sight comprising:

(1) an optical bench comprising at least one aperture positioned toward the front end of the housing;

(2) at least one laser tube disposed within the optical bench to emit a laser beam through the at least one aperture; and (3) a mounting block attaching the optical bench to an internal surface of the housing;

(d) a reflex sight attached to the housing, the reflex sight comprising:

(1) a base securely attached to the optical bench;

(2) a light source securely attached to the base; and (3) a lens assembly positioned frontward of the light source and configured to reflect a collimated light beam from the light source toward the rear end of the housing; and (e) a first adjustment mechanism for rotating the optical bench about the first pivot axis and a second adjustment mechanism for rotating the optical bench about the second pivot axis;

wherein the collimated light beam from the light source and the laser beam from the at least one laser tube are coaligned, and wherein the optical bench is rotationally adjustable within the housing about a first pivot axis and about a second pivot axis, wherein the longitudinal bore axis, the first pivot axis, and the second pivot axis are mutually orthogonal.

23. The integrated sight of claim 22, wherein the laser sight comprises an optical bench having three apertures positioned toward the front end of the housing and three laser tubes disposed within the optical bench to emit laser beams through an aligned one of the three apertures.

24. The integrated sight of claim 22, wherein the mounting block is integral with the optical bench.

25. The integrated sight of claim 22, wherein the mounting block is separately formed from the optical bench and attached thereto.

26. The integrated sight of claim 22, wherein at least one of the first adjustment mechanism and the second adjustment mechanism comprises:

(a) an assembly attached to the housing and a first surface of the optical bench, the assembly comprising:

(1) a barrel having an axis coincident with an adjustment axis, the barrel comprising:

(i) a first section in contact with the optical bench;

(ii) a second section adjacent to the first section, the second section having a thread running circumferentially on an outer surface of the second section;

(iii) a third section adjacent to the second section, the third section having two openings positioned diametrically in an outer surface of the third section;

(iv) a spring and a ball bearing disposed in each of the openings of the outer surface of the third section, the spring disposed between the ball bearing and the axis of the barrel; and (v) a fourth section comprising at least one feature enabling rotation of the barrel; and (2) a sleeve capable of receiving the barrel, the sleeve comprising:

(i) a first section having a thread running circumferentially on an inner surface of the first section and capable of engaging the thread on the second section of the barrel; and (ii) a second section having a scalloped surface defining a plurality of axially extending grooves on an inner surface of the second section; and (b) a spring disposed between an internal surface of the housing and a second surface of the optical bench, the first and second surfaces being on opposite sides of the optical bench.

* * * * *